US009046284B2

(12) United States Patent
Tamura et al.

(10) Patent No.: US 9,046,284 B2
(45) Date of Patent: Jun. 2, 2015

(54) AIR CONDITIONING APPARATUS

(75) Inventors: Hideya Tamura, Kawasaki (JP); Takahiro Matsunaga, Kawasaki (JP); Shinju Watanabe, Kawasaki (JP); Keito Kawai, Kawasaki (JP); Takashi Kimura, Kawasaki (JP); Kotaro Toya, Kawasaki (JP); Yasuhiro Oka, Kawasaki (JP); Ken Nakashima, Kawasaki (JP)

(73) Assignee: FUJITSU GENERAL LIMITED, Kawasaki-shi (JP)

( * ) Notice: Subject to any disclaimer, the term of this patent is extended or adjusted under 35 U.S.C. 154(b) by 341 days.

(21) Appl. No.: 13/615,290

(22) Filed: Sep. 13, 2012

(65) Prior Publication Data

US 2013/0081417 A1 Apr. 4, 2013

(30) Foreign Application Priority Data

Sep. 30, 2011 (JP) ..... 2011-216556
Mar. 30, 2012 (JP) ..... 2012-079427
Jul. 23, 2012 (JP) ..... 2012-162230

(51) Int. Cl.
*F25B 13/00* (2006.01)
*F25B 49/02* (2006.01)

(52) U.S. Cl.
CPC ..... *F25B 13/00* (2013.01); *F25B 49/027* (2013.01); *F25B 2313/0233* (2013.01); *F25B 2313/0253* (2013.01); *F25B 2313/005* (2013.01); *F25B 2313/02731* (2013.01); *F25B 2500/26* (2013.01); *F25B 2600/025* (2013.01)

(58) Field of Classification Search
CPC ..... F25B 6/00; F25B 6/02; F25B 13/00; F25B 30/02; F25B 49/027; F25B 2313/006; F25B 2313/0231
USPC ..... 62/159, 160, 228.1, 228.4
See application file for complete search history.

(56) References Cited

U.S. PATENT DOCUMENTS 5,277,034 A 1/1994 Hojo et al.
2008/0022710 A1 1/2008 Jeong et al.

FOREIGN PATENT DOCUMENTS

EP 2 354 722 A2 8/2011
JP 2012197959 A * 10/2012
JP 2013083426 A * 5/2013
JP 2013083427 A * 5/2013

OTHER PUBLICATIONS

Extended European Search Report in European Patent Application No. 12184774.3, dated Jun. 17, 2014.

* cited by examiner

*Primary Examiner* — Marc Norman
(74) *Attorney, Agent, or Firm* — Venable LLP; Michael A. Sartori; Tamatane J. Aga

(57) ABSTRACT

An air conditioning apparatus 1 includes first start control and second start control as its start control. In the first start control, first outdoor heat exchangers 24*a*, 24*b* are controlled to function as evaporators and second outdoor heat exchangers 25*a*, 25*b* are controlled to function as condensers. Thus, even when the compressors 21*a*, 21*b* are driven on at a given rotation number, the discharge pressures thereof can be prevented from increasing, thereby being able to prevent the internal pressures of the compressors 21*a*, 21*b* from increasing. Also, after end of the first start control, the first outdoor heat exchangers 24*a*, 24*b* and second outdoor heat exchangers 25*a*, 25*b* are all controlled to function as evaporators, and the compressors 21*a*, 21*b* are driven on at a given rotation number. This can shorten the rising time of the heating capacity in the start of the normal heating operation.

4 Claims, 11 Drawing Sheets

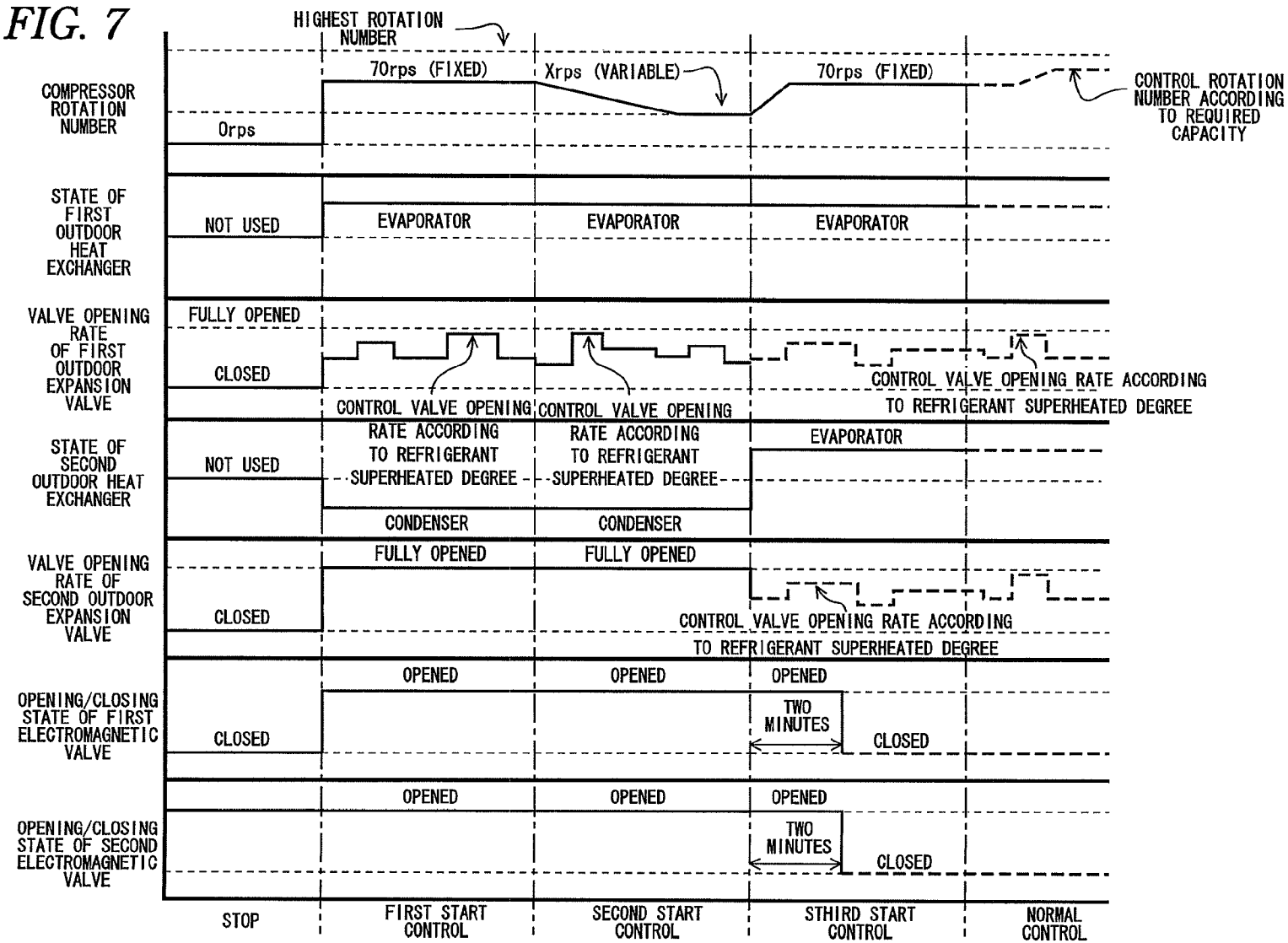
FIG. 7
COMPRESSOR ROTATION NUMBER
STATE OF FIRST OUTDOOR HEAT EXCHANGER
VALVE OPENING RATE OF FIRST OUTDOOR EXPANSION VALVE
STATE OF SECOND OUTDOOR HEAT EXCHANGER
VALVE OPENING RATE OF SECOND OUTDOOR EXPANSION VALVE
OPENING/CLOSING STATE OF FIRST ELECTROMAGNETIC VALVE
OPENING/CLOSING STATE OF SECOND ELECTROMAGNETIC VALVE
HIGHEST ROTATION NUMBER
70rps (FIXED)
Xrps (VARIABLE)
70rps (FIXED)
CONTROL ROTATION NUMBER ACCORDING TO REQUIRED CAPACITY
0rps
NOT USED
EVAPORATOR
EVAPORATOR
FULLY OPENED
CLOSED
CONTROL VALVE OPENING RATE ACCORDING TO REFRIGERANT SUPERHEATED DEGREE
CONTROL VALVE OPENING RATE ACCORDING TO REFRIGERANT SUPERHEATED DEGREE
NOT USED
CONDENSER
EVAPORATOR
CONDENSER
FULLY OPENED
FULLY OPENED
CLOSED
CONTROL VALVE OPENING RATE ACCORDING TO REFRIGERANT SUPERHEATED DEGREE
OPENED
OPENED
CLOSED
TWO MINUTES
CLOSED
OPENED
OPENED
OPENED
TWO MINUTES
CLOSED
STOP
FIRST START CONTROL
SECOND START CONTROL
STHIRD START CONTROL
NORMAL CONTROL

*FIG. 8*

200: ROTATION NUMBER TABLE

| OPEN-AIR TEMPERATURES T (°C) | ROTATION NUMBERS X (rps) |
|---|---|
| -10 OR LOWER | 70 |
| -9 | 68 |
| -8 | 65 |
| -7 | 63 |
| -6 | 61 |
| -5 | 58 |
| -4 | 56 |
| -3 | 54 |
| -2 | 51 |
| -1 | 49 |
| 0 | 46 |
| 1 | 44 |
| 2 | 42 |
| 3 | 39 |
| 4 | 37 |
| 5 | 35 |
| 6 | 32 |
| 7 | 30 |
| 8 | 28 |
| 9 | 25 |
| 10 | 23 |
| 11 OR HIGHER | 20 |

AIR CONDITIONING APPARATUS

CROSS-REFERENCE TO RELATED APPLICATIONS

The present application claims the benefit of priority of Japanese Patent Applications No. 2011-216556 filed on Sep. 30, 2011, No. 2012-079427 filed on Mar. 30, 2012, and No. 2012-162230 filed on Jul. 23, 2012, which is incorporated herein by reference.

BACKGROUND

1. Field of the Invention

The invention relates to an air conditioning apparatus including multiple outdoor units and multiple indoor units connected by multiple refrigerant pipes and, more specifically, it relates to such air conditioning apparatus capable of preventing a shortage of refrigerant unit oil within a compressor.

2. Related Art

Conventionally, there is proposed an air conditioning apparatus in which multiple indoor units are parallel connected to at least one outdoor unit by multiple refrigerant pipes and the respective indoor units can execute a cooling operation and a heating operation. For example, the patent reference 1 discloses an air conditioning apparatus of a so called cooling and heating free operation type in which two indoor units are parallel connected to an outdoor unit including two outdoor heat exchangers by a high pressure gas pipe, a low pressure gas pipe and a liquid pipe, and the two indoor units can independently execute a heating operation and a cooling operation selectively.

In the above air conditioning apparatus, the number of outdoor heat exchangers equipped in the outdoor unit is selected according to the operation capacity required of the two indoor units. When the operation capacity required of the two indoor units is low, one of the outdoor heat exchangers is used and, when the required capacity is high, both heat exchangers are used.

When the above air conditioning apparatus is installed in a cold district, or when the open-air temperature is low (for example, it is 0° C. or lower), for example, in the early morning or in the middle of the night in winter, there is a fear that, while the air conditioning apparatus is not in operation, a state where a refrigerant is dissolved in the refrigerating machine oil of a compressor, namely, so-called refrigerant dissolution can occur within a compressor provided in the outdoor unit.

When, in the refrigerant dissolution state, the operation of the air conditioning apparatus is started and the compressor is actuated, the refrigerant dissolved in the refrigerating machine oil evaporates to a gas refrigerant. When this gas refrigerant is discharged to the outside of the compressor, it catches and takes out the refrigerating machine oil to the outside of the compressor, thereby causing a shortage of the refrigerating machine oil within the compressor. This raises a fear that the poor lubrication of the compressor can occur.

Therefore, in an ordinary air conditioning apparatus, the rotation number of the compressor in its start time is controlled to a given rotation number previously determined for warming the compressor and, while maintaining this rotation number, the compressor is driven on for a given period of time to thereby eliminate the refrigerant dissolution within the compressor.

That is, by executing the above start control, the refrigerant dissolution, which had occurred in the start time of the compressor before, is eliminated to restrict the amount of the refrigerating machine oil to be taken out to the outside of the compressor by the gas refrigerant, thereby preventing the poor lubrication of the compressor.

SUMMARY

However, in the air conditioning apparatus executing the above start control, since, in the start control execution, the compressor is driven on while maintaining its rotation number at the given number, the compressor internal pressure increases. The increased compressor internal pressure can cause the refrigerant dissolution.

One or more embodiments of the present invention aims at solving the above problem. Thus, it is an object of the invention to provide an air conditioning apparatus which, in its start time, even when a compressor is driven on at a given rotation number, can prevent the increased internal pressure of the compressor.

In attaining the above object, according to one embodiments of the present invention, there is provided an air conditioning apparatus, comprising: at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the one or more compressors, outdoor expansion valves each connected to the other end of each of the outdoor heat exchangers for adjusting the refrigerant flow amount of the outdoor heat exchangers, and controller for executing the switching control of the flow passage switching devices and the valve opening rate control of the outdoor expansion valves; and, an indoor unit to be connected to the outdoor unit by at least two refrigerant pipes, wherein when a first given condition holds in the start operation of the outdoor unit, the controller executes first start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number.

Also, the controller, when a second given condition holds during execution of the first start control, the controller executes second start control following the first start control, in the second start control, the controller controls the flow passage switching devices corresponding to the outdoor heat exchangers to allow all of the outdoor heat exchangers used to function as condensers or evaporators, and continuously drives the one or more compressors at the same rotation number as in the first start control.

In attaining the above object, according to another embodiments of the present invention, there is provided an air conditioning apparatus, comprising: at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the one or more compressors, outdoor expansion valves each connected to the other end of each of the outdoor heat exchangers for adjusting the refrigerant flow amount of the outdoor heat exchangers, open-air temperature detecting device for detecting open-air temperatures, and controller for executing the switching control of the flow passage switching devices and the valve opening rate control of the outdoor expansion valves; and, an indoor unit to be connected to the outdoor unit by at least two refrigerant pipes, wherein when a first given condition holds in the start operation of the outdoor unit, the controller executes start control including first start control, second start control and third start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number, in the second start control executed following the first start control, the controller drives the one or more compressors at a rotation number predetermined according to the open-air temperature detected by the open-air temperature detecting device reduced from the predetermined rotation number in the first start control, and in the third start control executed following the second start control, the controller controls the flow passage switching devices corresponding to the outdoor heat exchangers to allow all of the outdoor heat exchangers used to function as condensers or evaporators, and drives the one or more compressors at the rotation number returned to the same rotation number set in the first start control.

In attaining the above object, according to another embodiments of the present invention, there is provided an air conditioning apparatus, comprising: at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the compressor, outdoor expansion valves each connected to the other end of each of the outdoor heat exchangers for adjusting the refrigerant flow amount of the outdoor heat exchangers, open-air temperature detecting device for detecting open-air temperatures, and controller for executing the switching control of the flow passage switching devices and the valve opening rate control of the outdoor expansion valves; and, an indoor unit to be connected to the outdoor unit by at least two refrigerant pipes, wherein the controller, when a first given condition holds in the start operation of the outdoor unit, executes start control including first start control, second start control and third start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number, in the second start control executed following the first start control, the controller drives the one or more compressors at a predetermined rotation number of the one or more compressors reduced from a given number of rotation in the first start control down to a predetermined rotation number according to the open-air temperature detected the one or more compressors at a rotation number predetermined according to the open-air temperature detected by the open-air temperature detecting device reduced from the predetermined rotation number in the first start control, and in the third start control executed following the second start control, the controller controls the flow passage switching devices corresponding to the outdoor heat exchangers to allow all of the outdoor heat exchangers used to function as condensers or evaporators, and to drive the one or more compressors at a rotation number maintained at the rotation number set in the second start control.

BRIEF DESCRIPTION OF DRAWINGS

FIG. 7 is a timing chart in a second embodiment of the invention, showing the operations of the respective composing elements when executing first, second and third start control;

FIG. 8 is a rotation number table for use in execution of the second start control in the second embodiment;

DETAILED DESCRIPTION

Hereinafter, description will be given below specifically of the mode for carrying out the invention with reference to the accompanying drawings. As an embodiment of this invention, there is taken an air conditioning apparatus of a so-called heating and cooling free operation type in which five indoor units are parallel connected to two outdoor units and the indoor units can independently execute a cooling operation and a heating operation selectively. Here, the invention is not limited to the following embodiments but can be modified variously without departing from the subject matter thereof.

Embodiment 1

Figure 1:
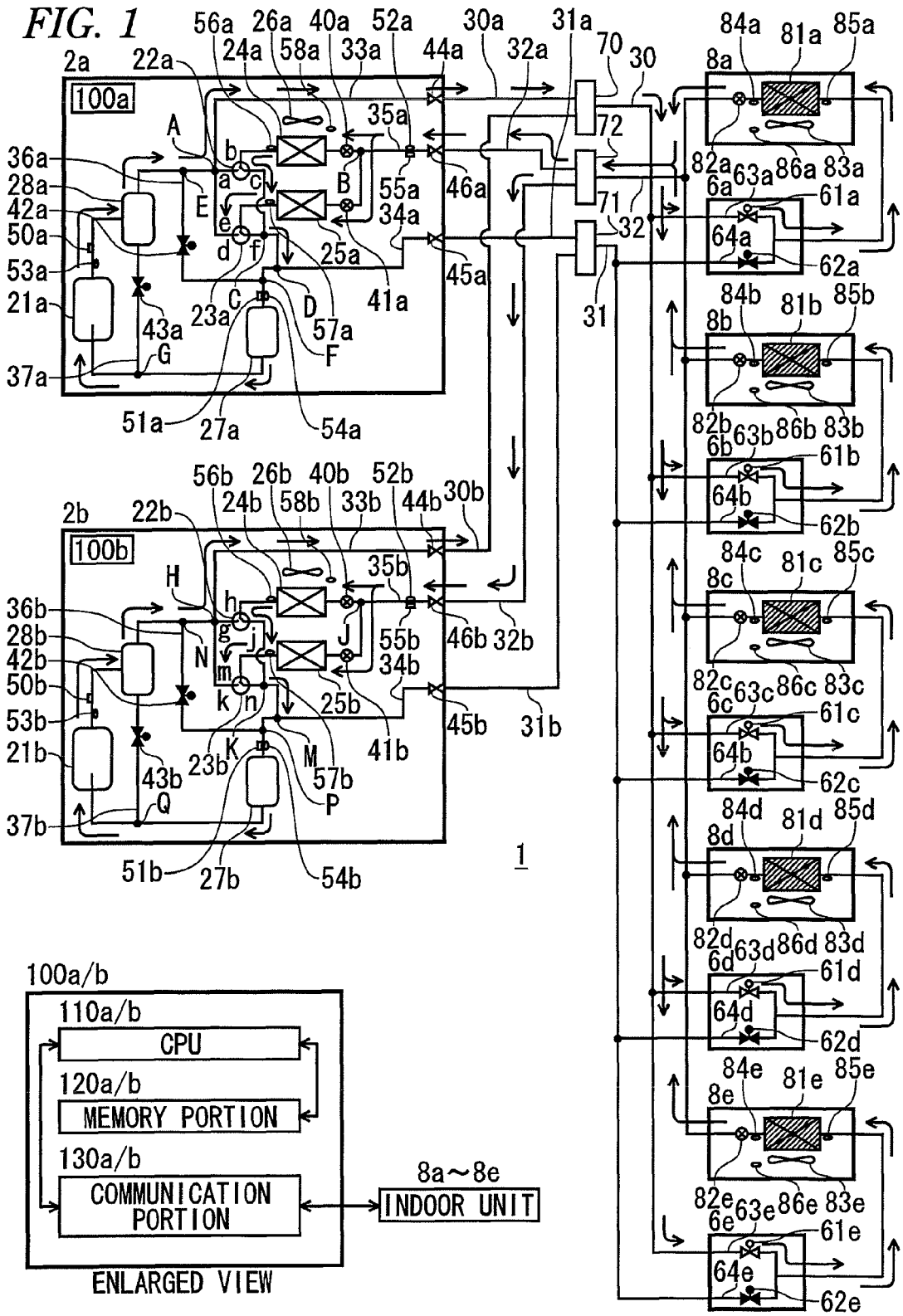
FIG. 1 is a refrigerant circuit of an air conditioning apparatus according to an embodiment of the invention, explaining the flow of a refrigerant when executing a heating operation.

As shown in FIG. 1, an air conditioning apparatus 1 of this embodiment includes two outdoor units 2*a*, 2*b*, five indoor units 8*a*-8*e*, five branch units 6*a*-6*e*, and turnout devices 70, 71, 72. The outdoor units 2*a*, 2*b*, five indoor units 8*a*-8*e*, five branch units 6*a*-6*e*, and turnout devices 70, 71, 72 are connected to their associated ones by a high pressure gas pipe 30, high pressure gas branch pipes 30*a*, 30*b*, a low pressure gas pipe 31, low pressure gas branch pipes 31*a*, 31*b*, a liquid pipe 32, and liquid branch pipes 32*a*, 32*b*, thereby constituting the refrigerant circuit of the air conditioning apparatus 1.

This air conditioning apparatus 1, according to the opened or closed states of various valves provided in the outdoor units 2*a*, 2*b* and branch units 6*a*-6*e*, can execute various operations such as a heating operation (all indoor units execute a heating operation), a heating-based operation (when the whole capacity required of the indoor units executing a heating operation exceeds the whole capacity required of the indoor units executing a cooling operation), a cooling operation (all indoor units execute a cooling operation), and a cooling-based operation (when the whole capacity required of the indoor units executing a cooling operation exceeds the whole capacity required of the indoor units executing a heating operation). In FIG. 1, description will be given of an example where, of these operations, the heating operation is executed.

Figure 2A:
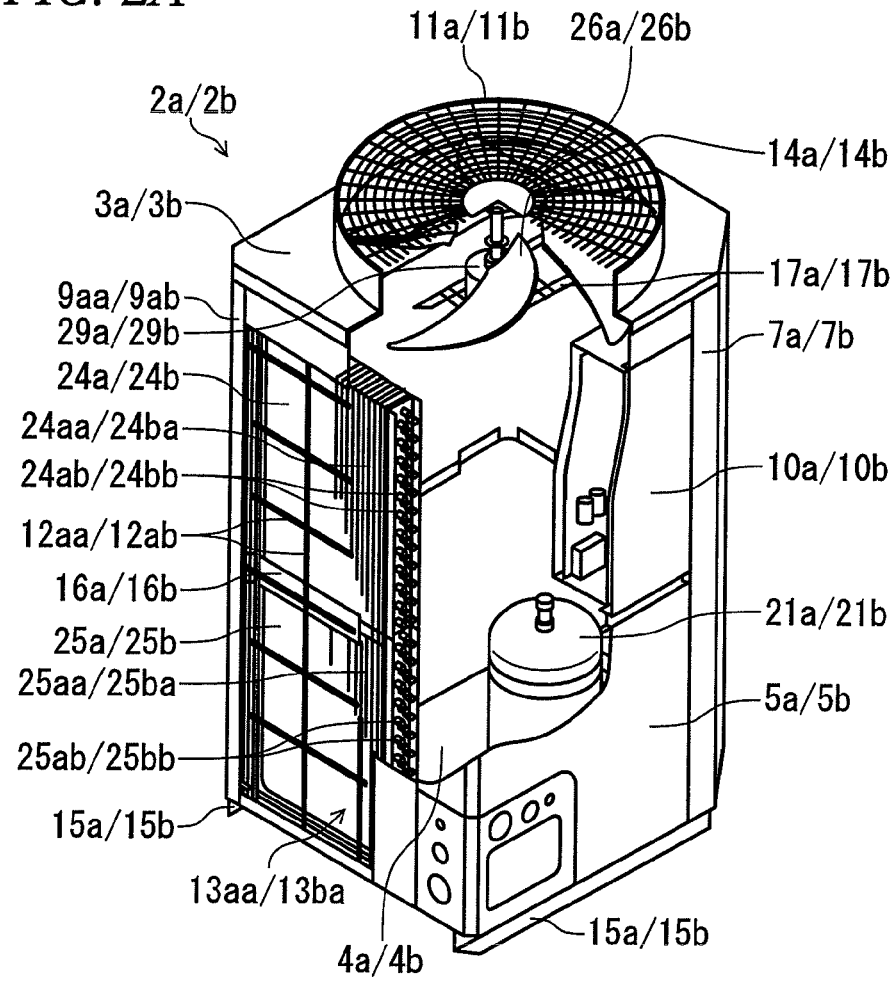
FIGS. 2A and 2B are schematic views of an outdoor unit in the embodiment of the invention.
Figure 2B:
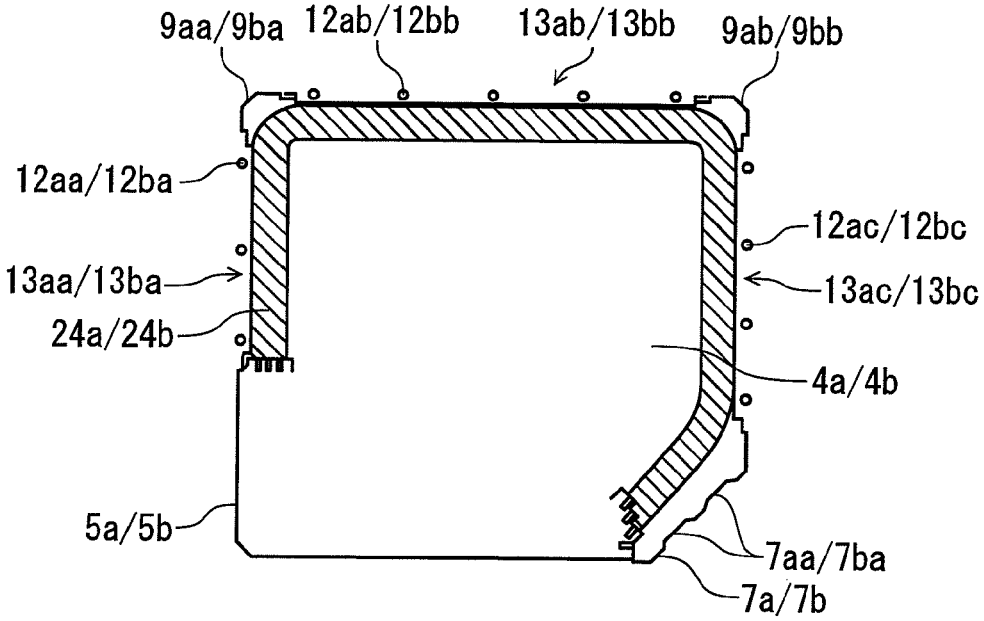

FIG. 1 is a refrigerant circuit when all indoor units 8*a*-8*e* are executing the heating operation, and FIGS. 2A and 2B are schematic views of the outdoor units 2*a*, 2*b*. Firstly, the outdoors 2*a*, 2*b* will be described. Here, since the outdoors 2*a*, 2*b* are all the same in structure, in the following description, only the structure of the outdoor unit 2*a* will be described, while the specific description of the outdoor unit 2*b* is omitted.

As shown in FIGS. 1, 2A, and 2B, the outdoor unit 2*a* includes an electrical equipment box 100*a* made of a thin plate for storing therein various substrates such as a control substrate and a power source substrate, a compressor 21*a*, a first three-way valve 22*a* and a second three-way valve 23*a* serving as flow passage switching devices, a first outdoor heat exchanger 24*a*, a second outdoor heat exchanger 25*a*, an outdoor fan 26*a*, a fan motor 29*a* having an output shaft connected to the outdoor fan 26*a* for rotating the outdoor fan 26*a*, an accumulator 27*a*, an oil separator 28*a*, a first outdoor expansion valve 40*a* connected to the first outdoor heat exchanger 24*a*, a second outdoor expansion valve 41*a* connected to the second outdoor heat exchanger 25*a*, a hot gas bypass pipe 36*a*, a first electromagnetic valve 42*a* provided on the hot gas bypass pipe 36*a*, an oil return pipe 37*a*, a second electromagnetic valve 43*a* provided on the oil return pipe 37*a*, and closing valves 44*a*-46*a*. These elements constituting the outdoor unit 2*a* are disposed within the box body of the outdoor unit 2*a* constituted of a top plate 3*a*, a bottom plate 4*a*, a front panel 5*a*, a front support 7*a*, a left support 9*aa*, a right support 9*ab* and a fan guard 11*a*.

As shown in FIGS. 2A and 2B, the front panel 5*a* is a steel plate bent formed substantially in L-like shape when viewed from the upper surface of the outdoor unit 2*a*, while it is disposed to cover most of the box body front surface of the outdoor unit 2*a* and part of the front side of the left side surface thereof. The front support 7*a*, as shown in FIG. 2B, is made of a steel plate including a grille 7*aa* for sucking the open-air into the outdoor unit 2*a*, while the two end portions thereof are bent at a given angle (obtuse angle) and the respective bent portions are disposed to cover part of the front surface of the box body of the outdoor unit 2*a* and part of the front side of the right side surface thereof. The left support 9*aa* and right support 9*ab* are substantially the same in shape and are respectively a steel plate worked to have a substantially L-like shape. The left support 9*aa* is disposed at the back surface side left corner portion of the bottom plate 4*a*, while the right support 9*ab* is disposed at the back surface side right corner portion thereof.

The box body left side surface side of the outdoor unit 2*a* is opened up between the side end of the front panel 5*a* and left support 9*aa* to form a suction opening 13*aa* for sucking the open-air into the outdoor unit 2*a*, while a lattice-shaped protect member 12*aa* is disposed in the suction opening 13*aa*. Also, the box body back surface side of the outdoor unit 2*a* is opened up between the left support 9*aa* and right support 9*ab* to form a suction opening 13*ab* for sucking the open-air into the outdoor unit 2*a*, while a lattice-shaped protect member 12*ab* is disposed in the suction opening 13*ab*. The box body right side surface side of the outdoor unit 2*a* is opened up between the front support 7*a* and right support 9*ab* to form a suction opening 13*ac* for sucking the open-air into the outdoor unit 2*a*, while a lattice-shaped protect member 12*ac* is disposed in the suction opening 13*ac*. Here, the portions of the respective suction openings 13*aa*-13*ac* corresponding to the suction openings of the first and second outdoor heat exchangers 24*a* and 25*a* are exposed.

As shown in FIG. 2A, the top plate 3*a* is a substantially square-shaped steel plate, while its peripheral edge portion provides a flange bent downward substantially at right angles. The top plate 3*a* can be assembled by screws to the respective upper ends of the front panel 5*a*, front support 7*a*, left support 9*aa* and right support 9*ab*. The top plate 3*a* includes, at a position corresponding to the outdoor fan 26*a* disposed on the upper portion of the box body, a discharge opening 11*a* opened circularly and having its peripheral portion bent upward substantially at right angles for discharging the open-air sucked into the outdoor unit 2*a* to the outside by the outdoor fan 26*a*. On the upper end of the discharge opening 11*a*, there is provided a fan guard 14 so as to cover the upper end of the discharge opening 11*a*. Here, the fan motor 29*a* is fixed to the upper end of the first heat exchanger 24*a* by a fixing metal member 17*a*.

The bottom plate 4*a* is a substantially square-shaped steel plate, while its peripheral portion provides a flange bent upward substantially at right angles. As shown in FIG. 2A, the bottom plate 4*a* can be assembled by screws to the respective lower ends of the front panel 5*a*, front support 7*a*, left support 9*aa* and right support 9*ab*. Here, the bottom plate 4*a* includes, in the lower surface thereof, leg portions 15*a* extending in the right and left directions of the outdoor unit 2*a* for installing the outdoor unit 2*a* on the ground, on the roof floor of a building or the like.

The compressor 21*a* is a capacity variable compressor the operating capacity of which can be varied when it is driven by a motor (not shown) with its rotation number controllable by an inverter and, as shown in FIG. 2A, it is fixed to the bottom plate 4*a*. Also, as shown in FIG. 1, the discharge side of the compressor 21*a* is connected to the inflow side of the oil separator 28*a* by a refrigerant pipe, while the flow-out side of the oil separator 28*a* is connected to the closing valve 44*a* by an outdoor unit high pressure gas pipe 33*a*. The suction side of the compressor 21*a* is connected to the flow-out side of the accumulator 27*a* by a refrigerant pipe, while the inflow side of the accumulator 27*a* is connected to the closing valve 45*a* by an outdoor unit low pressure gas pipe 34*a*.

The first and second three-way valves 22*a* and 23*a* are valves for switching the flow directions of the refrigerant. The first three-way valves 22*a* has three ports a, b, c, while the second three-way valves 23*a* has three ports d, e, f. In the first three-way valve 22*a*, a refrigerant pipe connected to the port a is connected to the outdoor unit high pressure gas pipe 33*a* at a connecting point A. The port b and first outdoor heat exchanger 24*a* are connected together by a refrigerant pipe, while a refrigerant pipe connected to the port c is connected to the outdoor unit low pressure gas pipe 34*a* at a connecting point D.

In the second three-way valve 23*a*, a refrigerant pipe connected to the port d is connected at the connecting point A to the outdoor high pressure gas pipe 33*a* and the refrigerant pipe connected to the port a of the first three-way valve 22*a*. The port e and second outdoor heat exchanger 25*a* are connected together by a refrigerant pipe, while a refrigerant pipe connected to the port f is connected at a connecting point C to a refrigerant pipe connected to the port c of the first three-way valve 22*a*.

As shown in FIG. 2B, the first and second outdoor heat exchangers 24*a* and 25*a* are each formed to have a substantially U-like shape when viewed from their upper surfaces, while the surfaces thereof are respectively disposed opposed to the suction openings 13*aa*-13*ac* formed in the outdoor unit 2*a*. The right side end portions of the first and second outdoor heat exchangers 24*a* and 25*a* are bent along the grille 7*aa* side surface of the front support 7*a*. As shown in FIG. 2A, the second outdoor heat exchanger 25*a* is fixed to the bottom plate 4*a* and the lower end of the first outdoor heat exchangers 24*a* is fixed through a fixing metal member 16*a* to the upper end of the second outdoor heat exchanger 25*a*, whereby the first and second outdoor heat exchangers 24*a* and 25*a* are disposed vertically.

The first outdoor heat exchanger 24*a* includes a large number of fins 24*aa* made of aluminum material and multiple steel pipes 24*ab* for allowing a refrigerant to flow therein. Also, the second outdoor heat exchanger 25*a*, similarly to the first outdoor heat exchangers 24*a*, includes a large number of fins 25*aa* made of aluminum material and multiple steel pipes 25*ab* made of copper material for allowing a refrigerant to flow therein.

As shown in FIG. 1, one end of the first outdoor heat exchanger 24*a*, as described above, is connected to the port b of the first three-way valve 22*a*, with the other end connected through a refrigerant pipe to one port of the first outdoor expansion valve 40*a*. Here, the other port of the first outdoor expansion valve 40*a* is connected to the closing valve 46*a* by an outdoor unit liquid pipe 35*a*. And, one end of the second outdoor heat exchanger 25*a*, as described above, is connected to the port e of the second three-way valve 23*a* through a refrigerant pipe, with the other end connected through a refrigerant pipe to one port of the second outdoor expansion valve 41*a*. Here, the other port of the second outdoor expansion valve 41*a* is connected to the connecting point B of the outdoor unit liquid pipe 35*a* by a refrigerant pipe.

The inflow side of the accumulator 27*a* is connected to an outdoor unit low pressure gas pipe 34*a*, with the outflow side connected to the suction side of the compressor 21*a* by a refrigerant pipe. The accumulator 27*a*, on receiving a refrigerant, divides it to a gas refrigerant and a liquid refrigerant, and allows the compressor 21*a* to suck only the gas refrigerant therein.

The inflow side of the oil separator 28*a* is connected to the discharge side of the compressor 21*a* by a refrigerant pipe, with the outflow outside connected to the outdoor unit high pressure gas pipe 33*a*. In the oil separator 28*a*, the refrigerating machine oil of the compressor 21*a* contained in the refrigerant discharged from the compressor 21*a* is separated from the refrigerant. Here, the separated refrigerating machine oil is sucked into the compressor 21*a* through an oil return pipe 37*a* (to be described later).

One end of the hot gas bypass pipe 36*a* is connected to the outdoor unit high pressure gas pipe 33*a* at the connecting point E, with the other end connected to the outdoor unit low pressure gas pipe 34*a* at the connecting point F. The hot gas bypass pipe 36*a* includes the first electromagnetic valve 42*a* and, by opening or closing the first electromagnetic valve 42*a*, the hot gas bypass pipe 36*a* can be switched between a refrigerant flow state and a refrigerant non-flow state.

One end of the oil return pipe 37*a* is connected to the oil return port of the oil separator 28*a*, with the other end connected at the connecting point G to a refrigerant pipe connecting the suction side of the compressor 21*a* and the outflow side of the accumulator 27*a*. The oil return pipe 37*a* includes a second electromagnetic valve 43*a* and, by opening or closing the second electromagnetic valve 43*a*, the oil return pipe 37*a* can be switched between a refrigerant flow state and a refrigerant non-flow state.

Besides the above composing elements, the outdoor unit 2*a* includes various sensors. As shown in FIG. 1, the refrigerant pipe connecting the discharge side of the compressor 21*a* and the oil separator 28*a* includes thereon a high pressure sensor 50*a* for detecting the pressure of a refrigerant discharged from the compressor 21*a* and a discharge temperature sensor 53*a* for detecting the temperature of a refrigerant discharged from the compressor 21*a*. And, between the connecting point F of the outdoor unit low pressure gas pipe 34*a* and the inflow side of the accumulator 27*a*, there are interposed a low pressure sensor 51*a* for detecting the pressure of a refrigerant sucked into the compressor 21*a*, and a suction temperature sensor 54*a* for detecting the temperature of a refrigerant sucked into the compressor 21*a*. Also, between the connecting point B of the outdoor unit liquid pipe 32*a* and closing valve 46*a*, there are interposed an intermediate pressure sensor 52*a* for detecting the pressure of a refrigerant flowing in the outdoor unit liquid pipe 35*a* and a refrigerant temperature sensor 55*a* for detecting the temperature of a refrigerant flowing in the outdoor unit liquid pipe 35*a*.

The refrigerant pipe connecting the port b of the first three-way valve 22*a* and first outdoor heat exchanger 24*a* includes a first heat exchanger temperature sensor 56*a* for detecting the temperature of a refrigerant flowing out from or flowing into the first outdoor heat exchanger 24*a*. And, the refrigerant pipe connecting the port e of the second three-way valve 23*a* and second outdoor heat exchanger 25*a* includes a second heat exchanger temperature sensor 57*a* for detecting the temperature of a refrigerant flowing out from or flowing into the second outdoor heat exchanger 25*a*. Also, the outdoor unit 2*a*, in the vicinity of any one of the suction openings 13*aa*-13*ac*, includes an open-air temperature sensor 58*a* for detecting the temperature of the open-air flowing into the outdoor unit 2*a*, that is, the open-air temperature.

The outdoor unit 2*a* includes a controller 100*a*. The controller 100*a* is mounted on a control substrate (not shown) stored in the electric equipment box 10*a* and includes a CPU 110*a*, a memory portion 120*a* and a communication portion 130*a*. CPU 110*a* receives detection signals from the above-mentioned sensors of the outdoor unit 2*a* and control signals output from the indoor units 8*a*-8*e* through the communication portion 130*a*. CPU 110*a*, according to the received detection signals and control signals, carries out various kinds of control including the drive control of the compressor 21*a*, the switching control of the first and second three-way valves 22*a* and 23*a*, the rotation control of the fan motor 29*a*, and the valve opening rate control of the first and second outdoor expansion valves 40*a* and 41*a*.

The memory portion 120*a* is constituted of a ROM and a RAM and stores therein detection values corresponding to the control programs of the outdoor unit 2*a* and the detected signals from the sensors. The communication portion 130*a* is an interface for communication between the outdoor unit 2*a* and indoor units 8*a*-8*e*. Here, the electric equipment box 10*a* for storing the controller 100*a* therein, as shown in FIG. 2A, is disposed on the box body front surface side upper portion (substantially flush with the first outdoor heat exchanger 24*a*) of the outdoor unit 2*a*.

The outdoor unit 2*b* is the same in structure as the outdoor unit 2*a* and thus the final numbers of the reference numerals of the composing elements (devices and members) of the outdoor unit 2*a* are changed from a to b to thereby represent the composing elements of the outdoor unit 2*b* corresponding to those of the outdoor unit 2*a*. However, the connecting points among the first three-way valve, second three-way valve and refrigerant pipes are given different signs between the outdoor units 2*a* and 2*b*. Specifically, those of the first three-way valve 22*b* of the outdoor unit 2*b* corresponding to the ports a, b, c of the first three-way valve 22*a* of the outdoor unit 2*a* are designated ports by g, h, j respectively, while those of the second three-way valve 23*b* of the outdoor unit 2*b* corresponding to the ports d, e, f of the second three-way valve 23*a* of the outdoor unit 2*a* are designated ports k, m, n. Also, those of the outdoor units 2*b* corresponding to the connecting points A, B, C, D, E, F, G of the outdoor unit 2*a* are designated connecting points H, J, K, M, N, P, Q.

As shown in FIG. 1, in the refrigerant circuit during the heating operation, the three-way valves are switched such that the two outdoor heat exchangers provided on the outdoor units 2*a*, 2*b* can function as evaporators. Specifically, in the outdoor unit 2*a*, the first three-way valve 22*a* is switched to allow communication between the ports b and c, and the second three-way valve 23*a* is switched to allow communication between the ports e and f. Also, in the outdoor unit 2*b*, the first three-way valve 22*b* is switched to allow communication between the ports h and j, and the second three-way valve 23*b* is switched to allow communication between the ports m and n. Here, in FIG. 1, the relationship between the ports of the three-way valves in communication is shown by a solid line, whereas the relationship between the ports of the three-way valves not in communication is shown by a broken line (this applies similarly in the following refrigerant circuit diagrams (FIGS. 3 and 4)).

The five indoor units 8*a*-8*e* include indoor heat exchangers 81*a*-81*e*, indoor expansion valves 82*a*-82*e* and indoor fans 83*a*-83*e*. The indoor units 8*a*-8*e* are all the same in structure. Therefore, in the following description, only the structure of the indoor unit 8*a* will be described and thus the description of the remaining indoor units 8*b*-8*e* will be omitted.

One end of the indoor heat exchanger 81*a* is connected to one port of the indoor expansion valve 82*a* by a refrigerant pipe, with the other end connected to the branch unit 6*a* (to be discussed later) by a refrigerant pipe. The indoor heat exchanger 81*a*, in the cooling operation of the indoor unit 8*a*, functions as an evaporator and, in the heating operation, functions as a condenser.

One port of the indoor expansion valve 82*a*, as described above, is connected to the indoor heat exchanger 81*a*, with the other port connected to the liquid pipe 32. When the indoor heat exchanger 81*a* functions as an evaporator, the valve opening rate of the indoor expansion valve 82*a* is adjusted according to a cooling capacity required and, when the indoor heat exchanger 81*a* functions as a condenser, the valve opening rate is adjusted according to a heating capacity required.

The indoor fan 83*a*, as it is rotated by a fan motor (not shown), sucks the indoor air into the indoor unit 8*a*, exchanges heat between the indoor air and refrigerant in the indoor heat exchanger 81*a*, and then supplies the heat exchanged air into a room.

Besides the above composing elements, the indoor unit 8*a* includes various sensors. A refrigerant pipe on the indoor expansion valve 82*a* side of the indoor heat exchanger 81*a* includes a refrigerant temperature sensor 84*a* for detecting the temperature of the refrigerant, and a refrigerant pipe on the branch unit 6*a* side of the indoor heat exchanger 81*a* includes a refrigerant temperature sensor 85*a* for detecting the temperature of the refrigerant. Near the indoor air suction port (not shown) of the indoor unit 8*a*, there is provided an indoor air temperature sensor 86*a* for detecting the temperature of the indoor air flowing into the indoor unit 8*a*, that is, the indoor temperature.

Here, the indoor units 8*b*-8*e* are the same in structure as the indoor unit 8*a*. Thus, the numbers of the reference numerals given to the composing elements (devices and members) of the indoor unit 8*a* is changed from a to b, c, d and e to thereby designate the composing elements of the indoor units 8*b*-8*e* corresponding to those of the indoor unit 8*a*.

The air conditioning apparatus 1 includes five branch units 6*a*-6*e* corresponding to the five indoor units 8*a*-8*e*. The branch units 6*a*-6*e* include electromagnetic valves 61*a*-61*e*, electromagnetic valves 62*a*-62*e*, first branch pipes 63*a*-63*e*, and second branch pipes 64*a*-64*e*. Here, the branch units 6*a*-6*e* are all the same in structure. Therefore, in the following description, only the structure of the branch unit 6*a* will be described, while omitting the description of other branch units 6*b*-6*e*.

One end of the first branch pipe 63*a* is connected to the high pressure gas pipe 30, while one end of the second branch pipe 64*a* is connected to the low pressure gas pipe 31. The other end of the first branch pipe 63*a* is connected to the other end of the second branch pipe 64*a*, while this connecting portion is connected to the indoor heat exchanger 81*a* by a refrigerant pipe. The first branch pipe 63*a* includes the electromagnetic valve 61*a*, while the second branch pipe 64*a* includes the electromagnetic valve 62*a*. By opening or closing the electromagnetic valves 61*a* and 62*a*, the refrigerant flow passage in the refrigerant circuit can be switched such that the indoor heat exchanger 81*a* of the indoor unit 8*a* corresponding to the branch unit 6*a* can be connected to the discharge side (high pressure gas pipe 30 side) or suction side (low pressure gas pipe 31 side) of the compressor 21.

Here, the structures of the branch units 6*b*-6*e*, as described above, are the same as the branch unit 6*a* and thus the final numbers of numerals given to the composing elements (devices and members) of the branch unit 6*a* are changed from a to b, c, d and e to thereby designate the composing elements of the branch units 6*b*-6*e*.

While using FIG. 1, description will be given below of the connecting states of the above-mentioned outdoor units 2*a*, 2*b*, indoor units 8*a*-8*e* and branch units 6*a*-6*e* to the high pressure gas pipe 30, high pressure gas branch pipes 30*a*, 30*b*, low pressure gas pipe 31, low pressure gas branch pipes 31*a*, 31*b*, liquid pipe 32, liquid branch pipes 32*a*, 32*b* and turn-out devices 70, 71, 72. The one-side ends of the high pressure branch pipes 30*a* and 30*b* are connected to the closing valves 44*a* and 44*b* of the outdoor units 2*a* and 2*b* respectively, while the other-side ends of the high pressure branch pipes 30*a* and 30*b* are respectively connected to the turn-out device 70. One end of the high pressure gas pipe 30 is connected to the turn-out device 70, while the other end is branched and connected to the first branch pipes 63*a*-63*e* of the branch units 6*a*-6*e*.

The one-side ends of the low pressure gas branch pipes 31*a* and 31*b* are connected to the closing valves 45*a* and 45*b* of the outdoor units 2*a* and 2*b* respectively, with the other-side ends respectively connected to the turn-out device 71. One end of the low pressure gas pipe 31 is connected to the turn-out device 71, with the other end branched and connected to the second branch pipes 64*a*-64*e* of the branch units 6*a*-6*e*.

The one-side ends of the liquid branch pipes 32*a* and 32*b* are connected to the closing valves 46*a* and 46*b* of the outdoor units 2*a* and 2*b*, with the other-side ends connected to the turn-out device 72. One end of the liquid pipe 32 is connected to the turn-out device 72, with the other end branched and connected to refrigerant pipes connected to the indoor expansion valves 82*a*-82*e* of the indoor units 8*a*-8*e*.

The indoor heat exchangers 81*a*-81*e* of the indoor units 8*a*-8*e* are connected to the connecting portions between the first branch pipes 63*a*-63*e* and second branch pipes 64*a*-64*b* of the corresponding branch units 6*a*-6*e* by refrigerant pipes. This connection constitutes the refrigerant circuit of the air conditioning apparatus 1 and a refrigeration cycle can be formed when a refrigerant is poured into the refrigerant circuit.

Next, description will be given below of the operation of the air conditioning apparatus 1 of this embodiment with reference to FIG. 1. Here, in FIG. 1, when the respective heat exchangers provided in the outdoor units 2*a*, 2*b* and indoor units 8*a*-8*e* serve as condensers, they are shown as hatched, whereas, when they serve as evaporators, they are shown as reversed. Also, when the first electromagnetic valves 42*a*, 42*b* and second electromagnetic valves 43*a*, 43*b* provided on the outdoor units 2*a*, 2*b* and the electromagnetic valves 61*a*-61*e* and electromagnetic valves 62*a*-62*e* provided on the branch units 6*a*-6*e* are closed, they are shown as black, whereas, when opened, they are shown as reversed. And, arrows designate the flows of refrigerants.

As shown in FIG. 1, when both outdoor units 2*a* and 2*b* must be operated because all the indoor units 8*a*-8*e* are executing heating operations to thereby require a high operation capacity, in the outdoor unit 2*a*, the ports b and c of the first three-way valve 22*a* are switched into communication to thereby allow the first outdoor heat exchanger 24*a* to function as an evaporator, and the ports e and f of the second three-way valve 23*a* are switched into communication to thereby allow the second outdoor heat exchanger 25*a* to function as an evaporator. Also, in the outdoor unit 2*b*, the ports h and i of the first three-way valve 22*b* are switched into communication to thereby allow the first outdoor heat exchanger 24*b* to function as an evaporator, and the ports m and n of the second three-way valve 23*b* are switched into communication to thereby allow the second outdoor heat exchanger 25*b* to function as an evaporator. Here, the first electromagnetic valves 42*a*, 42*b* and second electromagnetic valves 43*a*, 43*b* of the outdoor units 2*a*, 2*b* are all closed, while the hot gas bypass pipes 36*a*, 36*b* and oil return pipes 37*a*, 37*b* are all shut.

In the indoor units 8*a*-8*e*, the electromagnetic valves 61*a*-61*e* of their corresponding branch units 6*a*-6*e* are opened to allow the refrigerant to flow in the first branch pipes 63*a*-63*e* and the electromagnetic valves 62*a*-62*e* are closed to shut the second branch pipes 64*a*-64*e*. Accordingly, the indoor heat exchangers 81*a*-81*e* of the indoor units 8*a*-8*e* are all allowed to function as condensers.

High pressure refrigerants discharged from the compressors 21*a* and 21*b* flow through the oil separators 28*a* and 28*b* in the outdoor high pressure gas pipes 33*a* and 33*b*, and flow through the closing valves 44*a* and 44*b* into the high pressure branch pipes 30*a* and 30*b*. The high pressure refrigerants having flown into the high pressure branch pipes 30*a* and 30*b* join together in the turn-out device 70, flow in the high pressure gas pipe 30, and flow from the high pressure pipe 30 into the branch units 6*a*-6*e* after they are branched.

The high pressure refrigerants having flown into the branch units 6*a*-6*e* flow in the first branch pipes 63*a*-63*e* with the electromagnetic valves 61*a*-61*e* opened, flow out from the branch units 6*a*-6*e*, and flow into the indoor units 8*a*-8*e* respectively corresponding to the branch units 6*a*-6*e*.

The high pressure refrigerants having flown into the indoor units 8*a*-8*e* flow into the indoor heat exchangers 81*a*-81*e*, and exchange heat with respect to the indoor air to thereby condense. The condensed refrigerants heat the indoor air, thereby heating the inside of a room with the indoor units 8*a*-8*e* installed. The high pressure refrigerants having flown out from the indoor heat exchangers 81*a*-81*e* pass through the indoor expansion valves 82*a*-82*e*, whereby the pressures thereof are reduced. The valve opening rates of the indoor expansion valves 82*a*-82*e* are determined according to the super-cooled degrees of the refrigerants in the refrigerant exits of the indoor heat exchangers 81*a*-81*e*. The refrigerant super-cooled degree can be found, for example, by subtracting the refrigerant temperature in the refrigerant exits of the indoor heat exchangers 81*a*-81*e* from a high pressure saturation temperature (corresponding to a condensation temperature within the indoor heat exchangers 81*a*-81*e*) calculated from pressures detected by the high pressure sensors 50*a* and 50*b* of the outdoor units 2*a* and 2*b*.

The intermediate pressure refrigerants having flown out from the indoor units 8*a*-8*e* flow into the liquid pipe 32, join together within the liquid pipe 32 and then flow into the turn-out device 72. The intermediate pressure refrigerants having branched and flown from the turn-out device 72 into the liquid branch pipes 32*a* and 32*b* flow through the closing valves 46*a* and 46*b* into the outdoor units 2*a* and 2*b*. The intermediate pressure refrigerants having flown into the outdoor units 2*a* and 2*b* flow in the outdoor unit liquid pipes 35*a* and 35*b*, branch at the connecting points B and J, and flow through the first outdoor expansion valves 40*a*, 40*b* and second outdoor expansion valves 41*a*, 41*b*, whereby the pressures thereof are reduced to provide low pressure refrigerants.

The valve opening rates of the first outdoor expansion valves 40*a*, 40*b* are determined according to the superheated degrees of the refrigerants in the refrigerant exits of the first outdoor heat exchangers 24*a*, 24*b*. Also, the valve opening rates of the second outdoor expansion valves 41*a*, 41*b* are determined according to the superheated degrees of the refrigerants in the refrigerant exits of the second outdoor heat exchangers 25*a*, 25*b*. The superheated degrees of the refrigerants can be found, for example, by subtracting low pressure saturation temperatures calculated from pressures detected by the low pressure sensors 51*a*, 51*b* of the outdoor units 2*a*, 2*b* (corresponding to evaporation temperatures within the first outdoor heat exchangers 24*a*, 24*b* and second outdoor heat exchangers 25*a*, 25*b*) from refrigerant temperatures in the refrigerant exits of the first outdoor heat exchangers 24*a*, 24*b* and second outdoor heat exchangers 25*a*, 25*b* detected by the first heat exchanger temperature sensors 56*a*, 56*b* and second heat exchanger temperature sensors 57*a*, 57*b*.

The low pressure refrigerants pressure reduced by the first outdoor expansion valves 40*a*, 40*b* and second outdoor expansion valves 41*a*, 41*b* flow into the first outdoor heat exchangers 24*a*, 24*b* and second outdoor heat exchangers 25*a*, 25*b*, where they exchange heat with respect to the open-air and are thus caused to evaporate. The low pressure refrigerants having flown out from the first outdoor heat exchangers 24*a*, 24*b* and second outdoor heat exchangers 25*a*, 25*b* flow through the first three-way valves 22*a*, 22*b* and second three-way valves 23*a*, 23*b*, join together at the connecting portions C and K, and are sucked through the connecting points F, P, accumulators 27*a*, 27*b* into the compressors 21*a*, 21*b*, where they are compressed again.

Next, while using FIGS. 1 to 5, description will be given below of the operation of the refrigerant circuit of the invention and the operation effects thereof with reference to the air conditioning apparatus 1 of this embodiment. Here, in the following description, there is taken an example in which the air conditioning apparatus 1 is actuated to start the heating operation described using FIG. 1 and, specifically, the indoor units 8*a*-8*e* and outdoor units 2*a*, 2*b* are all operated.

For example, when the air conditioning apparatus 1 is installed in a cold region, or when the open air temperature is low (for example, 0° C. or lower), for example, late at night or early in the morning in a winter season, there is a fear that, within the compressors 21*a* and 21*b* not in operation, there has occurred so called refrigerant dissolution where refrigerants are dissolved in the refrigerating machine oil of the compressors 21*a*, 21*b*. When the compressors 21*a*, 21*b* are started in this state, there is a fear that the refrigerant dissolved in the refrigerating machine oil can evaporate to provide a gas refrigerant and, when the gas refrigerant is discharged from the compressors 21*a*, 21*b*, it can catch and take out the refrigerating machine oil outside the compressors 21*a*, 21*b*, resulting in the shortage of the refrigerating machine oil within the compressors 21*a*, 21*b*.

In this embodiment, to solve the above problem, in the start time of the air conditioning apparatus 1, there are executed first start control mainly for removing the refrigerant dissolution within the compressors 21*a* and 21*b* to reduce the amount of the refrigerating machine oil that is discharged together with the refrigerant, and second start control mainly for shortening the rising time of the heating operation capacity. The first and second start control will be described below specifically.

[First Start Control]

According to an operation start instruction or a timer start instruction by a user, the air conditioning apparatus 1 starts a heating operation. On receiving the operation start instruction through the indoor units 8*a*-8*e*, CPUs 110*a* and 110*b* of the controllers 100*a* and 100*b* of the outdoor units 2*a* and 2*b* check whether a first given condition, namely, the start condition of a first start control holds or not; and, when it holds, they start the first start control. Here, the start condition of the first start control is, for example, a condition showing a fear that refrigerant dissolution has occurred within the compressors 21*a* and 21*b* because the open-air temperature is a given temperature (for example, 5° C.) or lower and the compressors 21*a* and 21*b* have been continuously not in operation for a given time (for example, an hour) or longer. Here, when the start condition of the first start control does not hold, CPUs 110*a* and 110*b* carry out such control of the outdoor units 2*a* and 2*b* as corresponds to the normal air conditioning control.

Figure 5:
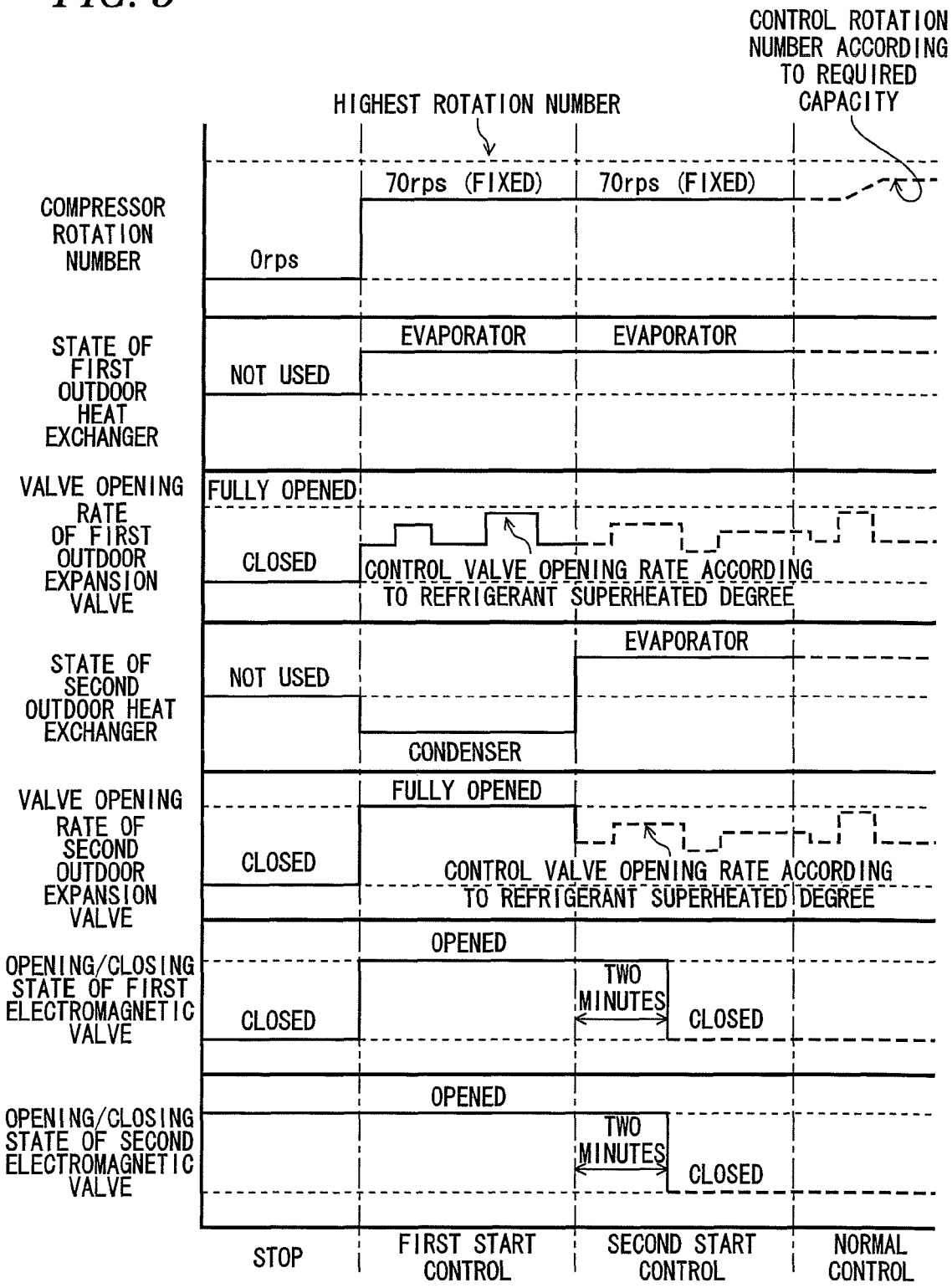
FIG. 5 is a timing chart in the embodiment of the invention, showing the operations of the respective composing elements when executing the first and second start control.

CPUs 110*a* and 110*b*, in the first start control, as shown in FIG. 5, execute the rotation number control of the compressors 21*a*, 21*b*, the function switching (evaporator/condenser switching) control of the first outdoor heat exchangers 24*a*, 24*b* and second outdoor heat exchangers 25*a*, 25*b*, the valve opening rate control of the first outdoor expansion valves 40*a*, 40*b* and second outdoor expansion valves 41*a*, 41*b*, and the opening and closing control of the first electromagnetic valves 42*a*, 42*b* and second electromagnetic valves 43*a*, 43*b*.

Figure 3:
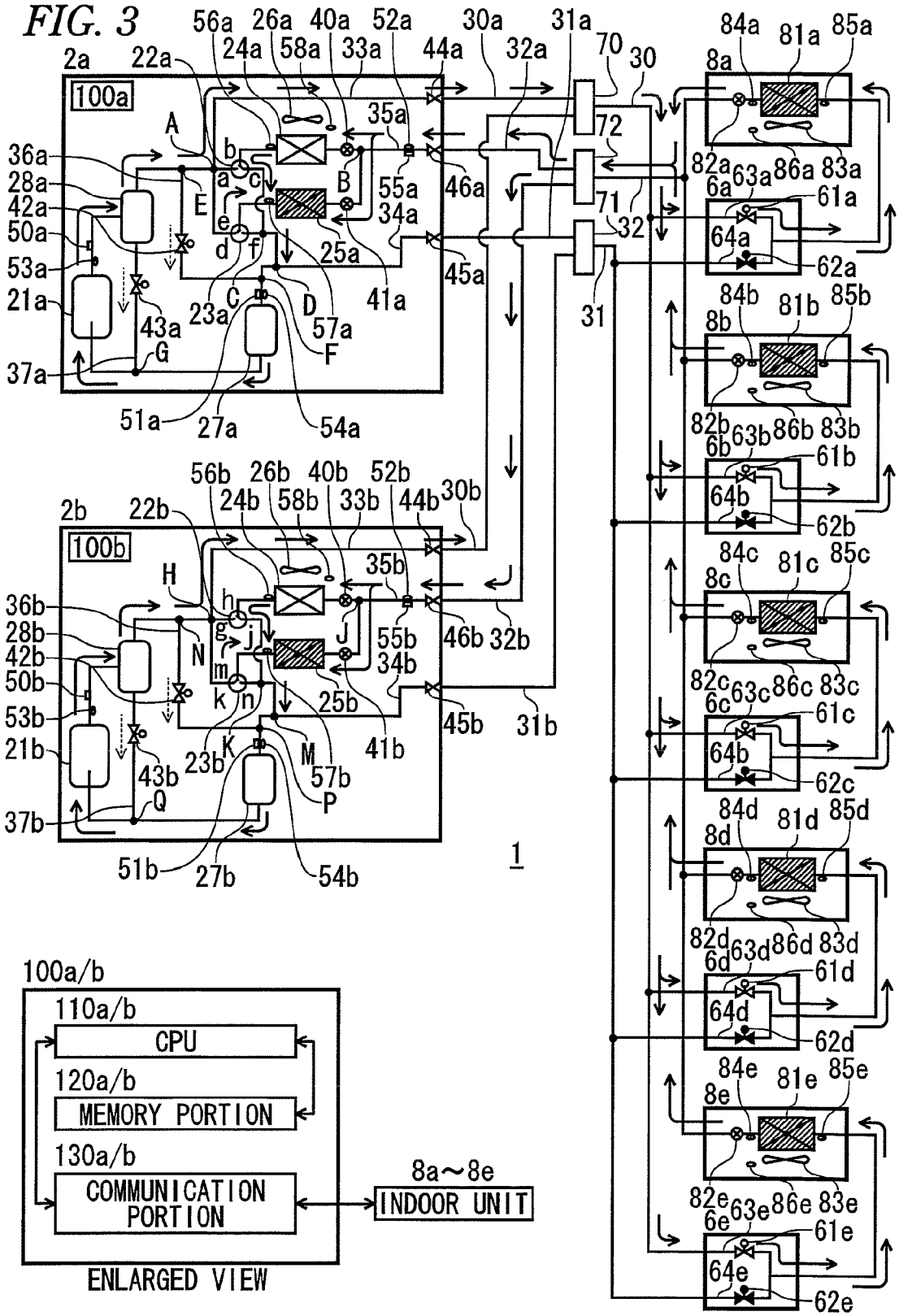
FIG. 3 is a refrigerant circuit in the embodiment of the invention, showing the flow of a refrigerant when executing first start control.

Specifically, as shown in FIG. 3, CPU 110*a* controls the first three-way valve 22*a* to bring the ports b and c into communication to thereby allow the first outdoor heat exchanger 24*a* to function as an evaporator, and controls the second three-way valve 23*a* to bring the ports d and e into communication to thereby allow the second outdoor heat exchanger 25*a* to function as a condenser. Also, CPU 110*b* controls the first three-way valve 22*b* to bring the ports h and j into communication to thereby allow the first outdoor heat exchanger 24*b* to function as an evaporator, and controls the second three-way valve 23*b* to bring the ports k and m into communication to thereby allow the second outdoor heat exchanger 25*b* to function as a condenser.

And, CPUs 110*a* and 110*b* maintain the compressors 21*a*, 21*b* at the start time rotation number which is a previously determined given rotation number. For example, as shown in FIG. 5, they start the compressors 21*a*, 21*b* at 70 rps and maintain this start time rotation number. When the compressors 21*a*, 21*b* start, as shown in FIG. 3, high pressure refrigerants discharged from the compressors 21*a*, 21*b* flow in the outdoor unit high pressure gas pipes 33*a*, 33*b* through oil separators 28*a*, 28*b*, and branch at the connecting points A and H into two refrigerants. One of them flows through the closing valves 44*a*, 44*b* into the indoor units 8*a*-8*e*, while the other flows through the second three-way valves 23*a*, 23*b* into the second outdoor heat exchangers 25*a*, 25*b* functioning as evaporators.

The high pressure refrigerant having flown into the second outdoor heat exchangers 25*a*, 25*b* exchanges heat with respect to the open-air to thereby condense and passes through the second outdoor expansion valves 41*a*, 41*b* fully opened by CPUs 110*a*, 110*b* as shown in FIG. 5, thereby being reduced in pressure. The intermediate pressure refrigerant having passed through the second outdoor expansion valves 41*a*, 41*b* joins the intermediate pressure refrigerant having flown from the indoor units 8*a*-8*e* at the connecting points B and J, and passes through the first outdoor expansion valves 40*a*, 40*b* opened at a given angle by CPUs 110*a*, 110*b* as shown in FIG. 5, thereby being reduced in pressure.

Here, the valve opening rates of the first outdoor expansion valves 40*a*, 40*b* are controlled by CPUs 110*a*, 110*b* according to the superheated degrees of the refrigerants in the refrigerant exits (existing on the first three-way valves 22*a*, 22*b* side) of the first outdoor heat exchangers 24*a*, 24*b*. The superheated degree of the refrigerant can be obtained, for example, by subtracting a low pressure saturation temperature (corresponding to an evaporation temperature within the first outdoor heat exchangers 24*a*, 24*b* calculated from pressure detected by the low pressure sensors 51*a*, 51*b* from the refrigerant temperature in the refrigerant exits of the first outdoor heat exchangers 24*a*, 24*b* detected by the first heat exchanger temperature sensors 56*a*, 56*b*.

The low pressure refrigerant having passed through the first outdoor expansion valves 40*a*, 40*b* exchanges heat with respect to the open-air in the first outdoor heat exchangers 24*a*, 24*b* to thereby evaporate, and is sucked through the first three-way valves 22*a*, 22*b* and accumulators 27*a*, 27*b* into the compressors 21*a*, 21*b*. Also, as shown in FIG. 5, CPUs 110*a*, 110*b* open the first electromagnetic valves 43*a*, 43*b* to thereby allow the refrigerant to flow in the hot gas bypass pipes 36*a*, 36*b*. Here, as shown in FIG. 5, the second electromagnetic valves 44*a*, 44*b* are set to open when the outdoor units 2*a*, 2*b* are not in operation and, also when executing the first start control, they maintain their open states, thereby allowing the refrigerant to flow in the oil return pipes 37*a*, 37*b*.

When there is a fear that refrigerant dissolution has occurred within the compressors 21*a*, 21*b*, in the start time of the air conditioning apparatus 1, preferably, by executing the start control to drive the compressors 21*a*, 21*b* at the rotation numbers that is the start time rotation numbers, namely, predetermined rotation numbers, the temperatures of the compressors 21*a*, 21*b* may be raised quickly to thereby quickly separate the refrigerant dissolved in the refrigerating machine oil from the refrigerating machine oil. Here, the start time rotation number, in consideration of the amount of discharge of the refrigerating machine oil increasing with the increased rotation number of the compressor, is set as a number as large as possible in the range where the discharge amount of the refrigerating machine oil is a given amount or less. However, when the compressors 21*a*, 21*b* are driven on at the start time rotation numbers, the internal pressures of the compressors 21*a*, 21*b* are caused to increase. This raises a fear that refrigerant dissolution cause by the increased pressure can occur within the compressors 21*a*, 21*b*.

On the other hand, in the first start control of the invention, when driving the compressor 21*a*, 21*b* with their rotation numbers maintained at the start time rotation numbers, one of the two outdoor heat exchangers, namely, the second outdoor heat exchanger 25*a*, 25*b* is allowed to function as a condenser, thereby being able to prevent the high pressure (the pressure on the discharge side of the compressor 21*a*, 21*b*) from increasing.

Also, when executing the first start control, the first electromagnetic valve 43*a*, 43*b* and second electromagnetic valve 44*a*, 44*b* are opened to thereby allow the refrigerant to flow in the hot gas bypass pipe 36*a*, 36*b* and oil return pipe 37*a*, 37*b*. Since the hot gas bypass pipe 36*a*, 36*b* bypasses the outdoor unit high pressure gas pipe 33*a*, 33*b* and outdoor unit low pressure gas pipe 34*a*, as shown by a broken arrow line in FIG. 3, the refrigerant flows from the connecting point E to F, or from the connecting point N to P to thereby prevent the high pressure (pressure on the discharge side of the compressor 21*a*, 21*b*) from increasing. Also, since the oil return pipe 37*a*, 37*b* bypasses the outdoor unit high pressure gas pipe 33*a*, 33*b* and outdoor unit low pressure gas pipe 34*a* through the oil separator 28*a*, 28*b*, as shown by a broken arrow line in FIG. 3, the refrigerant flows together with the refrigerating machine oil from the oil separator 28*a*, 28*b* to the compressor 21*a*, 21*b* to thereby prevent the high pressure (pressure on the discharge side of the compressor 21*a*, 21*b*) from increasing.

As described above, in the first start control, since CPU 110*a*, 110*b* control the second outdoor heat exchangers 25*a*, 25*b* to function as condensers and control the oil return pipes 37*a*, 37*b* to allow the refrigerants to flow therein, thereby being able to prevent the high pressure from increasing. Thus, even when the compressor 21*a*, 21*b* are driven on at the start time rotation numbers, the increased internal pressures of the compressor 21*a*, 21*b* can be prevented. This can prevent the occurrence of the refrigerant dissolution within the compressor 21*a*, 21*b* caused by the increased internal pressures of the compressor 21*a*, 21*b*.

In the above-described first start control, the second outdoor heat exchangers 25*a*, 25*b* are controlled to function as condensers, while the hot gas bypass pipe 36*a*, 36*b* and oil return pipe 37*a*, 37*b* are controlled to allow the refrigerant to flow therein. However, when, by controlling one of the pipes, the increased internal pressures of the compressor 21*a*, 21*b* due to the continuous driving of the compressor 21*a*, 21*b* at the start time rotation numbers can be prevented, only one of the pipes may also be controlled. Also, the hot gas bypass pipe 36*a*, 36*b* and oil return pipe 37*a*, 37*b* are controlled to allow the refrigerant to flow therein. However, when, by controlling only one of the pipes to allow the refrigerant to flow therein, the increased internal pressures of the compressor 21*a*, 21*b* due to the continuous driving of the compressor 21*a*, 21*b* at the start time rotation numbers can be prevented, only one of the pipes may also be controlled to allow the refrigerant to flow therein.

Also, in the first start control, of the two outdoor heat exchangers, the first outdoor heat exchanger 24*a*, 24*b* is controlled to function as an evaporator. As shown in FIGS. 2A and 2B, the first outdoor heat exchanger 24*a*, 24*b* is disposed nearer to the outdoor fan 26*a*, 26*b* than the second outdoor heat exchanger 25*a*, 25*b*.

When an outdoor heat exchanger functioning as an evaporator runs short of evaporation capacity, there is a fear that a liquid refrigerant having failed to evaporate fully in the outdoor heat exchanger can be sucked back into the compressor, that is, a so called liquid refrigerant back can occur. This raises a fear that, when the liquid refrigerant is compressed, the compressor can be damaged.

To prevent the above-mentioned liquid refrigerant back caused by the shortage of the evaporation capacity, in the first start control, the first outdoor heat exchanger 24*a*, 24*b*, which is disposed upwardly of the second outdoor heat exchanger 25*a*, 25*b* and is thereby nearer to the outdoor fan 26*a*, 26*b* than the heat exchanger 25*a*, 25*b*, is controlled to function as an evaporator. The nearer to the outdoor fan 26*a*, 26*b* the heat exchanger is, the more the passage amount of the open-air sucked into the outdoor units 2*a*, 2*b* is. Therefore, the evaporation capacity of the first outdoor heat exchanger 24*a*, 24*b* is higher than when the second outdoor heat exchanger 25*a*, 25*b* is used as an evaporator.

This can prevent the occurrence of the liquid refrigerant back caused by the short evaporation capacity of the first outdoor heat exchanger 24*a*, 24*b* functioning as an evaporator. Here, as described above, since the valve opening rate of the first outdoor expansion valve 40*a*, 40*b* corresponding to the first outdoor heat exchanger 24*a*, 24*b* functioning as an evaporator is controlled according to the superheated degree of the refrigerant in the refrigerant exit (existing on the first three-way valve 22*a*, 22*b* side), the higher evaporation capacity of the first outdoor heat exchanger 24*a*, 24*b* can be secured, thereby being able to prevent the occurrence of the liquid refrigerant back more effectively.

CPU 110*a*, 110*b*, during execution of the first start control, is checking whether a second given condition, namely, the end condition of the first start control holds or not. When it holds, CPU 110*a* or 110*b* ends the first start control and moves to the second start control to be explained next. Here, the first start control end condition is, for example, a condition which, when the discharge superheat degree of the compressor 21*a*, 21*b* after passage of a given time (for example, a minute) from the start of the first start control reaches a given temperature (for example, 8° C.), can restrict to some degree the refrigerating machine oil discharged together with the refrigerant from the compressor 21*a*, 21*b*. Here, to obtain the discharge superheat degree of the compressor 21*a*, 21*b*, a high pressure saturation temperature (corresponding to a condensation temperature within the second outdoor heat exchanger 25*a*, 25*b*) found from the pressure detected by the high pressure sensor 50*a*, 50*b* may be subtracted from a refrigerant temperature detected by the discharge temperature sensor 53*a*, 53*b*.

[Second Start Control]

CPU 110*a*, 110*b* starts the second start control following the first start control. As described above, since, in the first start control, the refrigerant dissolution in the compressor 21*a*, 21*b* has been eliminated to a certain degree to provide such refrigerating machine oil discharge amount as causes no interference with the lubrication of the compressor 21*a*, 21*b*, in the second start control, there are executed various kinds of control which reduce the refrigerant dissolution amount in the compressor 21*a*, 21*b* and shorten the rising time of the air conditioning capacity. Therefore, although, in the first start control, the two outdoor heat exchangers are structured different in function to thereby allow the evaporator and condenser to coexist in the outdoor unit, in the second start control, when an operation mode is a heating/heating-based operation, the two outdoor heat exchangers are both used to function as an evaporator and, for a cooling/cooling-based operation, both are used to function as a condenser.

In this embodiment, in order for the air conditioning apparatus 1 to carry out a heating operation, CPU 110*a*, 110*b*, in the second start control, as shown in FIG. 5, executes the control of the rotation number of the compressor 21*a*, 21*b*, the control of the function switching of the second outdoor heat exchanger 25*a*, 25*b* (switching from condenser to evaporator. The first outdoor heat exchanger 24*a*, 24*b* maintains this state because it is set to function as an evaporator in the first start control), the valve opening rate control of the first outdoor expansion valve 40*a*, 40*b* and second outdoor expansion valve 41*a*, 41*b*, and the opening/closing control of the first electromagnetic valve 42*a*, 42*b* and second electromagnetic valve 43*a*, 43*b*.

Figure 4:
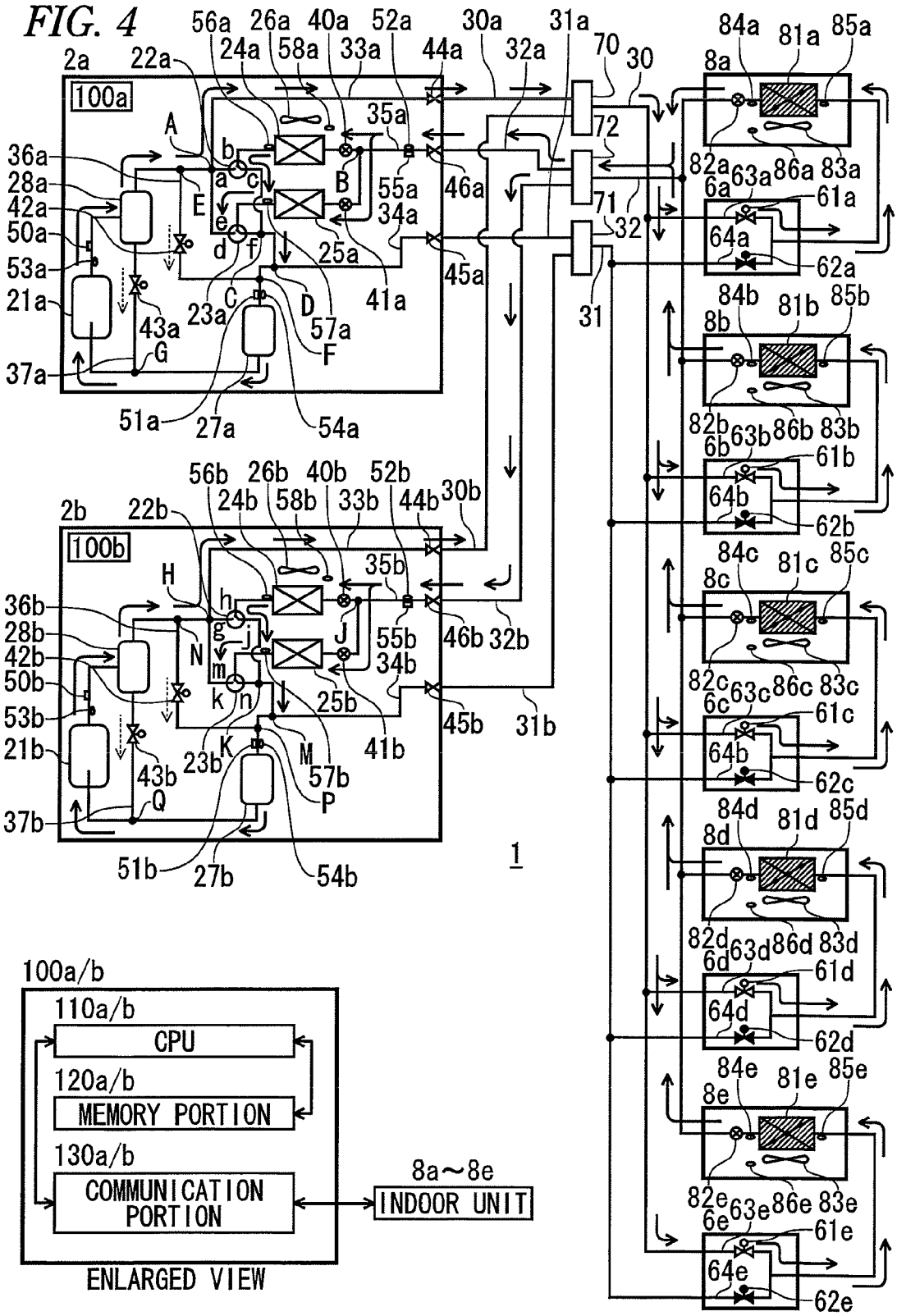
FIG. 4 is a refrigerant circuit in the embodiment of the invention, showing the flow of a refrigerant when executing second start control.

Specifically, CPUs 110*a*, 110*b*, as shown in FIG. 4, switch the second three-way valve 23*a* to bring the ports e and f into communication and the second three-way valve 23*a* to bring the ports m and n into communication, thereby allowing the second heat exchangers 25*a*, 25*b* to function as an evaporator. Also, CPUs 110*a*, 110*b*, as shown in FIG. 5, drive on the compressors 21*a*, 21*b* while maintaining 70 rps, namely, the start time rotation number, and maintain the opened states of the first electromagnetic valves 43*a*, 43*b* and second electromagnetic valves 44*a*, 44*b*, thereby allowing the refrigerant to flow in the hot gas bypass pipes 36*a*, 36*b* and oil return pipes 37*a*, 37*b*.

Also, CPUs 110*a*, 110*b*, as shown in FIG. 5, control the valve opening rates of the first outdoor expansion valves 40*a*, 40*b* according to the superheated degrees of the refrigerants in the refrigerant exits of the first outdoor heat exchangers 24*a*, 24*b*, and control the valve opening rates of the second outdoor expansion valves 41*a*, 41*b* according to the superheated degrees of the refrigerants in the refrigerant exits of the second outdoor heat exchangers 25*a*, 25*b*. Here, the refrigerant circuit shown in FIG. 4 during execution of the second start control is the same as the refrigerant circuit described in FIG. 1 except for the states (where the refrigerant flows/does not flow) of the hot gas bypass pipes 36*a*, 36*b* and oil return pipes 37*a*, 37*b*. Thus, the specific description of the flow of the refrigerant and the like is omitted here.

In the second start control, as described above, the second outdoor heat exchangers 25*a*, 25*b* having functioned as a condenser in the first start control are switched to function as an evaporator, while the compressors 21*a*, 21*b* are still driven on while maintaining 70 rps, or the start time rotation number. Since the compressors 21*a*, 21*b* have been heated in the first start control, even when the condenser is removed from the refrigerant circuit, there is reduced the amount of refrigerant dissolution due to the increased internal pressures of the compressors 21*a*, 21*b* caused by maintaining the start time rotation number. Therefore, in the second start control, since, while the first outdoor heat exchangers 24*a*, 24*b* and second outdoor heat exchangers 25*a*, 25*b* are both used as an evaporator, that is, according to a refrigerant circuit in a heating operation, the compressors 21*a*, 21*b* are driven with their rotation numbers maintained at 70 rps, the compressors 21*a*, 21*b* are heated to thereby be able to further reduce the refrigerant dissolution amount in the compressors 21*a*, 21*b* and also shorten the rising time of the heating operation capacity.

Also, when the second outdoor heat exchangers 25*a*, 25*b* having functioned as a condenser are switched to function as an evaporator, the high pressure increases transitionally, thereby raising a fear that the compression rates of the compressors 21*a*, 21*b* can increase. The increased compression rates can damage the compressors 21*a*, 21*b*. Thus, in the second start control, as shown in FIG. 5, the first electromagnetic valves 42*a*, 42*b* and second electromagnetic valves 43*a*, 43*b*, which have been opened in the first start control execution time, are remained opened for a given time (time necessary for the transitional increase in the high pressure to stop, for example, for two minute). This allows the refrigerant to flow in the hot gas bypass pipes 36*a*, 36*b* and oil return pipes 37*a*, 37*b* and thus the increase in the high pressure can be prevented. This can prevent the increased compression rates of the compressors 21*a*, 21*b* and thus can prevent them against damage.

In the second start control, since the second outdoor heat exchangers 25*a*, 25*b* are switched in function from a condenser to an evaporator, the first three-way valves 22*a*, 22*b* side portions of the second outdoor heat exchangers 25*a*, 25*b* are connected to the suction side portions of the compressors 21*a*, 21*b* respectively. Thus, liquid refrigerants, which stay in the second outdoor heat exchangers 25*a*, 25*b* functioning as a condenser and are not evaporated fully when the heat exchangers are switched to an evaporator, flow through the second three-way valves 23*a*, 23*b* and connecting points C, K into the outdoor unit low pressure gas pipes 34*a*, 34*b*.

In this state, for example, when the compressor 21*b* is stopping, the liquid refrigerant staying in the second outdoor heat exchanger 25*b* flows from the second three-way valve 23*b* through the connecting points K, M into the outdoor unit low pressure gas pipe 34*b* and then flows through the low pressure gas branch pipe 31*b*, turn-out device 71 and low pressure gas branch pipe 31*a* sequentially into the outdoor unit 2*a*. After then, the liquid refrigerant flows through the outdoor unit low pressure gas pipe 34*a* into the accumulator 27*a* via the connecting point F. Consequently, there is a fear that the refrigerants are concentrated in the outdoor unit 2*a* including the currently driven compressor 21*a* to thereby cause an overflow in the accumulator 27*a*.

Thus, in the second start control of the invention, all compressors having been driven in the first start control, in this embodiment, the compressors 21*a*, 21*b* are also continuously driven. Accordingly, when the second outdoor heat exchangers 25*a*, 2*b* are switched in function from a condenser to an evaporator, the liquid refrigerants staying in the second outdoor heat exchangers 25*a*, 2*b* are allowed to flow into their associated accumulators 27*a*, 27*b*. This can eliminate the inconvenience that the refrigerants can be concentrated in one of the outdoor units and thus an overflow can occur in the associated accumulator.

CPUs 110*a*, 110*b*, during execution of the second start control, are checking whether the end condition of the second start control holds or not. When the end condition holds, they end the second start control, that is, end the start control of the air conditioning apparatus 1 and transfer their control to the normal air-conditioning control. Here, the end condition of the second start control is a condition where the refrigerant dissolution within the compressors 21*a*, 21*b* is removed to thereby prevent the refrigerating machine oil from being discharged together with the refrigerant any more, for example, when the discharge superheated degrees of the compressors 21*a*, 21*b* after passage of a given time (for example, a minute) from the initiation of the second start control reach a given temperature (for example, 12° C.) or higher.

Figure 6:
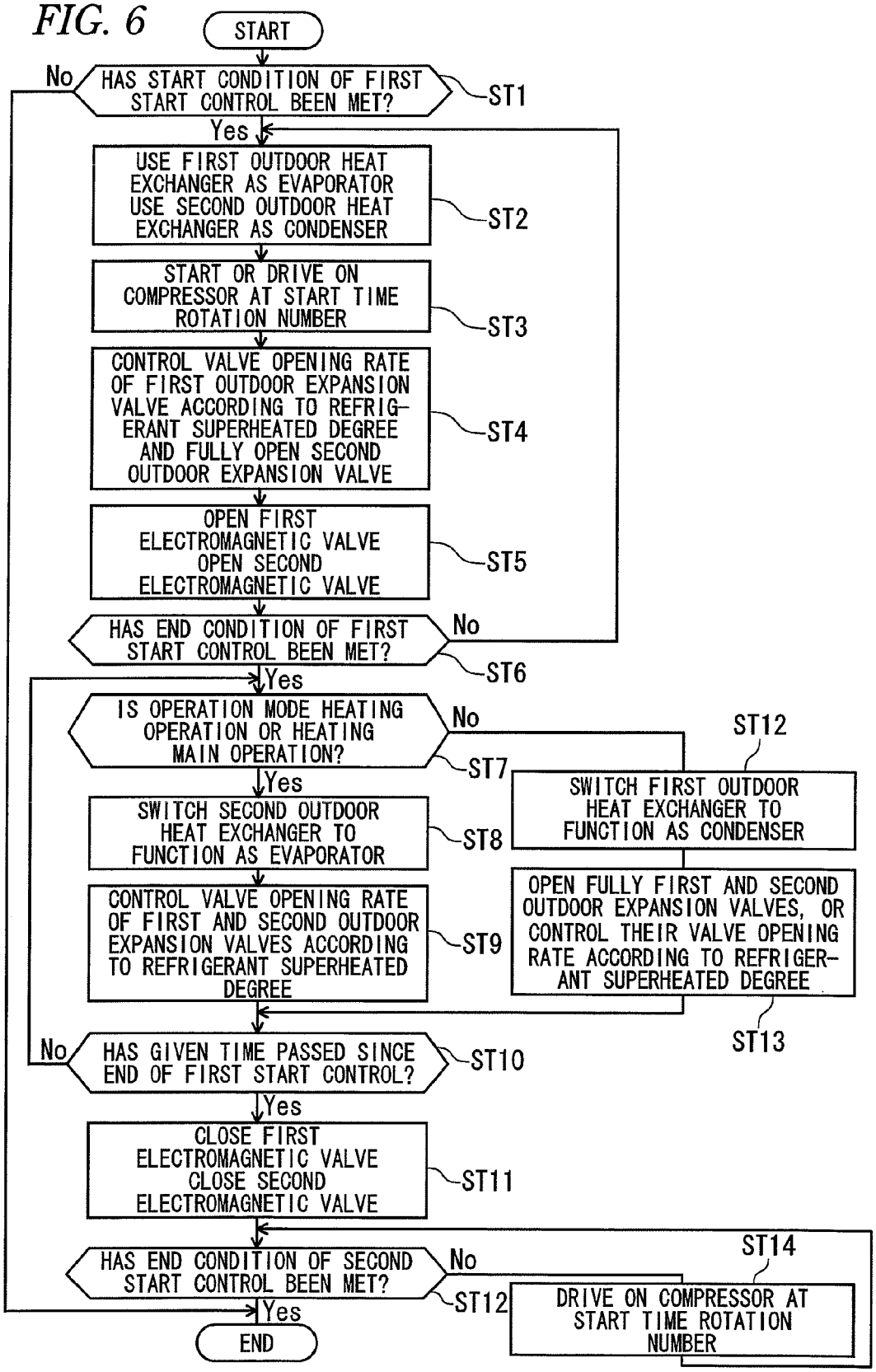
FIG. 6 is a flow chart in the embodiment of the invention, showing processings to be executed by controller.

Next, description will be given below of the flow of processings to be executed by the air conditioning apparatus 1 of this embodiment with reference to a flow chart shown in FIG. 6. The flow chart of FIG. 6 shows the flow of processings relating to the first and second start control to be carried out when the air conditioning apparatus 1 starts its operation, wherein ST designates steps and a numeral following ST designates the step number. Here, in FIG. 6, description is given mainly of processings relating to the invention, while omitting the description of other ordinary processings such as the control of a refrigerant circuit corresponding to operation conditions such as temperatures and air amounts specified by a user. Also, since the processings relating to the first and second start control to be executed by CPUs 110*a*, 110*b* are the same, in the following description, description will be given of processings relating to the first and second start control to be executed by CPU 110*a* included in the controller 100*a* of the outdoor unit 2*a*.

On receiving an operation start instruction, CPU 110*a* checks whether the start condition of the first start control holds or not (ST1). When the condition holds (ST1—Yes), CPU 110*a* controls the first three-way valve 22*a* to allow the first outdoor heat exchanger 24*a* to function as an evaporator and controls the second three-way valve 23*a* to allow the second outdoor heat exchanger 25*a* to function as an evaporator (ST2).

Next, CPU 110*a* controls the compressor 21*a* to start at the start time rotation number, or, to be driven on at the start time rotation number (ST3).

Next, CPU 110*a* controls the valve opening rate of the first outdoor expansion valve 40*a* according to the refrigerant superheated degree in the refrigerant exit of the first outdoor heat exchanger 24*a* and opens the second outdoor expansion valve 41 fully (ST4).

Next, CPU 110*a* controls opens the first electromagnetic valve 42*a* (ST5) to thereby allow the refrigerant to flow in the hot gas bypass 36*a*. Here, as described above, the second electromagnetic valve 43*a* has been opened since the stopping time of the outdoor unit 2*a* and CPU 110*a* maintains this state to allow the refrigerant to flow in the oil return pipe 37*a*.

Next, CPU 110*a* checks whether the end condition of the first start control holds or not (ST6). When not (ST6—No), CPU 110*a* returns the processing to ST2, where it continues the first start control.

When the end condition holds (ST—Yes), CPU 110*a* ends the first start control and moves to the second start control. CPU 110*a* checks whether an operation mode instructed by a user is a heating operation or a heating-based operation or not (ST7).

When it is a heating operation or a heating-based operation (ST7—Yes), CPU 110*a* switches the function of the second outdoor heat exchanger 25*a* from a condenser to an evaporator (ST8). Next, CPU 110*a* controls the valve opening rate of the first outdoor expansion valve 40*a* according to the refrigerant superheated degree in the refrigerant exit of the first outdoor heat exchanger 24*a* and controls the valve opening rate of the second outdoor expansion valve 41*a* according to the refrigerant superheated degree in the refrigerant exit of the second outdoor heat exchanger 25*a* (ST9).

Next, CPU 110*a*, after end of the first start control, starts a timer and checks whether a given time after end of the first start control, for example, two minutes have passed or not (ST10). When not (ST10—No), CPU 110*a* returns the processing to ST7.

When the given time has passed (ST10—Yes), CPU 110*a* closes the first and second electromagnetic valves 42*a* and 43*a* (ST11), thereby shutting the hot gas bypass pipe 36*a* and oil return pipe 37*a*.

Next, CPU 110*a* checks whether the end condition of the second start control holds or not (ST12). When not (ST12—No), CPU 110*a* drives on the compressor 21*a* at the start time rotation number (ST14) and returns the processing to ST12, where it continues the second start control. When the end condition holds (ST12—Yes), CPU 110*a* ends the second start control, namely, ends the start control of the air conditioning apparatus 1 and starts the normal air-conditioning control.

Here, when the start condition of the first start control does not hold in ST1 (ST1—No), CPU 110*a* does not execute the start control but starts the normal air-conditioning control.

Also, when the operation mode is not a heating operation or a heating-based operation (ST7—No), since the operation mode instructed by the user is a cooling operation or a cooling-based operation, CPU 110*a* switches the function of the first outdoor heat exchanger 24*a* from an evaporator to a condenser (ST12). Next, CPU 110*a* opens the first outdoor expansion valve 40*a* fully, or controls the valve opening rate thereof according to the refrigerant super-cooled degree in the refrigerant exit of the first outdoor heat exchanger 24*a*, and also opens the second outdoor expansion valve 41*a* fully, or controls the valve opening rate thereof according to the refrigerant super-cooled degree in the refrigerant exit of the second outdoor heat exchanger 25*a* (ST13). Then, CPU 110*a* advances the processing to ST10.

Embodiment 2

Next, description will be given below of a second embodiment of the air conditioning apparatus of the invention. Here, since the structure and running operation of the air conditioning apparatus and the start condition of start control to be executed when the air conditioning apparatus starts are the same as those of the first embodiment, the description thereof is omitted. This embodiment is different from the first embodiment in that, between the first and second start control of the first embodiment, there is inserted control to reduce the rotation number of the compressor.

Now, description will be given below of the operations of a refrigerant circuit of this embodiment and the operation effects thereof in the air conditioning apparatus 1 of this embodiment with reference to FIGS. 1 to 4, 7 and 8. Here, in the following description, similarly to the first embodiment, description will be given while taking an example where the air conditioning apparatus 1 starts its own operation and initiates the heating operation described with reference to FIG. 1 and the indoor units 8*a*-8*e* and outdoor units 2*a*, 2*b* are all operated.

In the first embodiment, in the case that the start control start condition (the start condition of the first start control) holds when the air conditioning apparatus 1 starts a heating operation, CPUs 110*a*, 110*b* execute the first start control and, following the end of the first start control, execute the second start control. When the control is switched from the first start control to the second start control, the second outdoor heat exchangers 25*a*, 25*b* functioning as condensers in the first start control are switched to function as evaporators. This removes the outdoor heat exchanger functioning as a condenser, thereby increasing the high pressure (the pressure on the discharge sides of the compressors 21*a*, 21*b*).

At the then time, when the open-air temperature is relatively high (for example, −9° C. or higher), since the second outdoor heat exchangers 25*a*, 25*b* functioning as condensers are switched to function as evaporators, the condensation capacity is reduced. This increases the high pressure and thus the operation loads of the compressors 21*a*, 21*b*, raising a fear that the discharge outputs of the compressors 21*a*, 21*b* can exceed the upper limit values thereof. This raises a fear that overload protection control to stop the compressors 21*a*, 21*b* to thereby prevent the increased discharge outputs can be executed.

In this embodiment, to solve the above problem, as shown in FIG. 7, when the air conditioning apparatus 1 starts its operation, there is carried out start control, including: first start control (the same control as the first start control in the first embodiment) to be executed mainly to eliminate the refrigerant dissolution within the compressors 21*a*, 21*b* to thereby reduce the amount of refrigerating machine oil to be discharged together with the refrigerant; second start control to be executed mainly to prevent an increase in the discharge pressures of the compressors 21*a*, 21*b*; and, third start control (the same control as the second start control in the first embodiment except for the control of the rotation numbers of the compressors 21*a*, 21*b*) to be executed mainly to shorten the rising time of the heating operation capacity.

Although description will be given below of the above-mentioned respective start control specifically, the description of the first start control is omitted because it is the same as the first start control in the first embodiment including the start and end conditions. Also, since the third start control is the same as the second start control in the first embodiment except for the rotation numbers (to be discussed later) of the compressors 21*a*, 21*b*, the description thereof is omitted. Further, in the following description, the lower limit rotation number in the rotation number range allowed in the compressors 21*a*, 21*b* is assumed to be 20 rps.

[Second Start Control]

When the end condition of the first start control holds, CPUs 110*a*, 110*b* start the second start control following the first start control. In the second start control, the rotation numbers of the compressors 21*a*, 21*b* are reduced at a given rate from 70 rps, namely, the rotation number (start time rotation number) during the first start control execution down to a rotation number X (rps) previously set according to the open-air temperatures, thereby reducing the discharge pressures of the compressors 21*a*, 21*b*.

In memory portions 120*a*, 120*b* respectively corresponding to CPU 110*a*, 110*b*, there is previously stored a rotation number table 200 shown in FIG. 8. The table 200 sets the rotation numbers X (rps) of the compressors 21*a*, 21*b* according to the then-time open-air temperatures T (° C.) when executing the second start control. In this table, by previously conducting tests and the like, it has been confirmed that, when the rotation numbers of the compressors 21*a*, 21*b* are reduced down to the rotation numbers X, the discharge pressures of the compressors 21*a*, 21*b* are prevented from exceeding their upper limit values at the corresponding open-air temperatures T.

In the rotation number table 200, the open-air temperatures T are divided by 1° C. between "−10° C. or lower" and "11° C. or higher". The rotation numbers X are determined correspondingly to the open-air temperatures T. Specifically, when the open-air temperatures T are "−10° C. or lower", since a fear of the discharge pressures of the compressors 21*a*, 21*b* exceeding their upper limit values is low, the rotation number X is set at "70 rps", namely, the start time rotation number.

When the open-air temperatures T are higher than −10° C., there is a fear that the discharge pressures of the compressors 21*a*, 21*b* can exceed the upper limit values and, the higher the open-air temperatures T become, the higher the possibility of the discharge outputs exceeding the upper limit values becomes. Therefore, in the rotation number table 200, the higher the open-air temperatures T become, the lower the rotation numbers X become. For example, when the open-air temperature T is −5°, the rotation number X is 58 rps; for the open-air temperature T of 0° C., 46 rps; and, for the open-air temperature T of 5° C., 35 rps. For the open-air temperature T of 11° C. or higher, the rotation number X is 20 rps or the lower limit rotation number.

Next, description will be given below of the specific operations of the respective composing elements of the outdoor units 2*a*, 2*b* when executing the second start control. CPUs 110*a*, 110*b*, in the second start control, as shown in FIG. 7, execute the rotation number control of the compressors 21*a*, 21*b*, the function switching (evaporator/condenser switching) control of the first outdoor heat exchangers 24*a*, 24*b* and second outdoor heat exchangers 25*a*, 25*b*, the valve opening rate control of the first outdoor expansion valves 40*a*, 40*b* and second outdoor expansion valves 41*a*, 41*b*, and the opening/closing control of the first electromagnetic valves 42*a*, 42*b* and second electromagnetic valves 43*a*, 43*b*.

The above respective kinds of control included in the second start control are similar to those of the first start control except for the rotation number control of the compressors 21*a*, 21*b*. Therefore, the description thereof is omitted here and thus the rotation number control of the compressors 21*a*, 21*b* will be described below specifically. Here, the state of the refrigerant circuit of the air conditioning apparatus 1 when executing the second start control is similar to that of the first start control in the first embodiment, that is, the state shown in FIG. 3.

The memory portions 120*a*, 120*b* store therein in a time series manner the open-air temperatures detected at a given timing (for example, every two seconds) by the open-air temperature sensors 58*a*, 58*b* serving as the open-air temperature detecting devices provided in the respective outdoor units 2*a*, 2*b*. On starting the second start control, CPUs 110*a*, 110*b* import the finally stored open-air temperature T from the open-air temperatures stored in the memory portions 120*a*, 120*b*. CPUs 110*a*, 110*b* refer to the rotation number table 200 similarly stored in the memory portions 120*a*, 120*b* and extract from the rotation number table 200 the rotation number X corresponding to the imported open-air temperature T.

Next, CPUs 110*a*, 110*b* reduce the rotation number of the compressors 21*a*, 21*b* from the current rotation number, namely, 70 rps or the start time rotation number down to the extracted rotation number X at a predetermined given rate. For example, when the open-air temperature T is 0° C. and the given rate for reducing the rotation number is 2 rps/sec, since the rotation number table 200 shows that the rotation number X when the open-air temperature T is 0° C. is 46 rps, CPUs 110*a*, 110*b* reduce the rotation number of the compressors 21*a*, 21*b* down to 46 rps in twelve seconds ((70 rps−46 rps)/2 rps/sec=12 seconds). By reducing the rotation numbers of the compressors 21*a*, 21*b* in this manner, the discharge outputs of the compressors 21*a*, 21*b* are reduced.

CPUs 110*a*, 110*b*, during execution of the second start control, is checking whether the end condition of the second start control holds or not, and when the end condition holds, end the second start control and move to third start control to be described next. Here, the end condition of the second start control is, for example, whether a given time has passed since the start of the second start control or not. This given time is a previously determined in consideration of time necessary to reduce the rotation numbers of the compressors 21*a*, 21*b* down to the lower limit rotation number, 20 rps. For example, when a given rate for reducing the rotation number is above-mentioned 2 rps/1 sec, there is obtained (70 rps−20 rps)/2 rps=25 seconds.

Therefore, when time necessary to reduce the rotation numbers of the compressors 21*a*, 21*b* down to the rotation number X corresponding to the open-air temperature T is shorter than the given time (for example, 25 seconds), CPUs 110*a*, 110*b*, after reducing the rotation numbers of the compressors 21*a*, 21*b* down to the rotation number X, drive the compressors 21*a*, 21*b* while maintaining the rotation number X until the given time. For example, as described above, since the rotation number X is 46 rps when the open-air temperature T is 0° C. and thus 12 seconds are necessary to reduce the rotation number down to this rotation number, CPUs 110*a*, 110*b* drive the compressors 21*a*, 21*b* at 46 rps for the remaining thirteen seconds. Here, since, when the open-air temperature is −10° C. or lower, the rotation number X is 70 rps or the start time rotation number, CPUs 110*a*, 110*b* drive the compressors 21*a*, 21*b* for a given time (25 seconds) while maintaining 70 rps.

[Third Start Control]

CPUs 110*a*, 110*b* start the third start control following the second start control. The execution of the first start control has relieved the refrigerant dissolution in the compressors 21*a*, 21*b* to a certain degree to thereby provide such amount of discharge of refrigerating machine oil as cannot interfere with the lubrication of the compressors 21*a*, 21*b*. Also, the execution of the second start control has reduced the discharge pressures of the compressors 21*a*, 21*b*. In the third start control, while decreasing the refrigerant dissolution amount in the compressors 21*a*, 21*b* and controlling the discharge pressures of the compressors 21*a*, 21*b* not to exceed the upper limit values thereof, there are executed various kinds of control for shortening the rising time of the air conditioning capacity.

Therefore, in the first and second start control, two outdoor heat exchangers are controlled to differ in function, whereby an evaporator and a condenser are intermingled within the outdoor unit. On the other hand, in the third start control, when the operation mode is a heating operation or a heating-based operation, both outdoor heat exchangers are controlled to function as evaporators and, for a cooling operation or a cooling-based operation, they are controlled to function as condensers.

Next, description will be given of the specific operations of the respective composing elements of the outdoor units 2*a*, 2*a* when executing the third start control. In this embodiment, in order for the air conditioning apparatus 1 to carry out a heating operation, CPU 110*a*, 110*b*, in the third start control, as shown in FIG. 7, execute the rotation number control of the compressors 21*a*, 21*b*, the function switching (switching from condenser to evaporator. Since the first outdoor heat exchangers 24*a*, 24*b* are controlled to function as evaporators in the first and second start control, they are maintained in state) control of the second outdoor heat exchangers 25*a*, 25*b*, the valve opening rate control of the first outdoor expansion valves 40*a*, 40*b* and second outdoor expansion valves 41*a*, 41*b*, and the opening/closing control of the first electromagnetic valves 42*a*, 42*b* and second electromagnetic valves 43*a*, 43*b*.

The above-mentioned kinds of control except for the rotation number control of the compressors 21*a*, 21*b* are similar to those of the second start control in the first embodiment including the end condition and, therefore, the description thereof is omitted here. Thus, the rotation number control of the compressors 21*a*, 21*b* will be described below specifically. Here, the state of the refrigerant circuit of the air conditioning apparatus 1 when executing the third start control is similar to the state for the second start control in the first embodiment, or, the state shown in FIG. 4.

CPUs 110*a*, 110*b*, when starting the third start control, execute the control to return the rotation numbers of the compressors 21*a*, 21*b* to 70 rps or the start time rotation number. Specifically, CPUs 110*a*, 110*b* increase gradually the rotation number of the compressors 21*a*, 21*b* up to 70 rps at a given rate and, after reaching 70 rps, drive on the compressors 21*a*, 21*b* until the end of the third start control while maintaining this rotation number (70 rps).

Here, a given rate, at which the rotation numbers of the compressors 21*a*, 21*b* are increased, is a rate so determined to be able to prevent the discharge outputs of the compressors 21*a*, 21*b* from exceeding their upper limit values when the rotation numbers of the compressors 21*a*, 21*b* are increased suddenly. For example, in the case that, when the given rate for increasing the rotation numbers of the compressors 21*a*, 21*b* is 10 rps/30 sec. and, in the second start control, the open-air temperature T is 7° C., the rotation numbers of the compressors 21*a*, 21*b* have been reduced down to the rotation number X: 30 rps corresponding to such open-air temperature T, time necessary for the rotation numbers of the compressors 21*a*, 21*b* to increase from 30 rps to 70 rps is 120 seconds ((70 rps−30 rps)/10 rps)×30 seconds=120 seconds).

As described above, by gradually increasing the rotation numbers of the compressors 21*a*, 21*b* up to 70 rps, the discharge outputs of the compressors 21*a*, 21*b* are prevented from exceeding their upper limit values. Here, as described above, the end condition of the third start control is the same as that of the second start control in the first embodiment. Thus, when the end condition of the third start control holds, CPU 110*a*, 110*b* end the start control of the air conditioning apparatus 1 and move to their normal air conditioning control.

Figure 9:
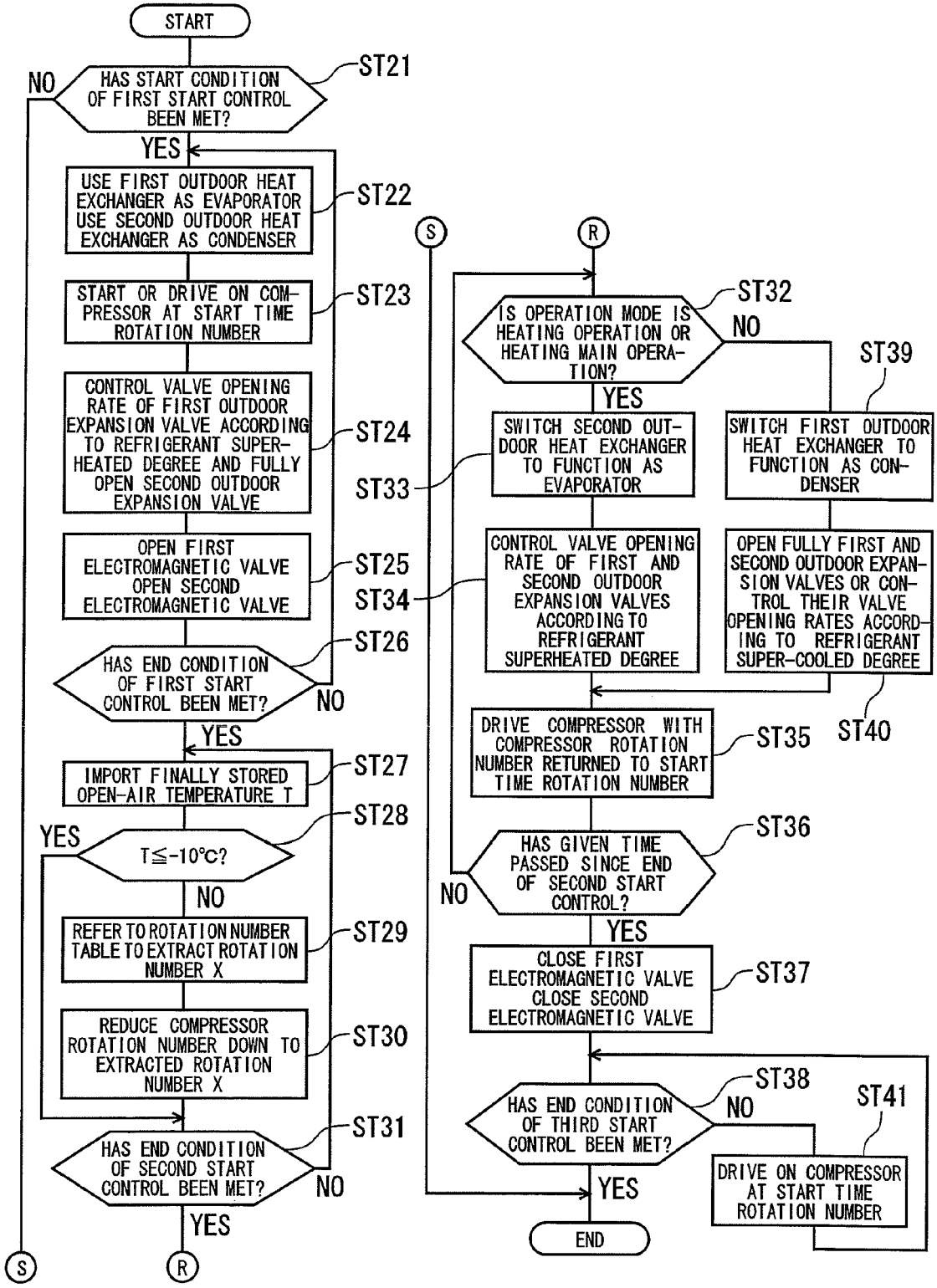
FIG. 9 is a flow chart of processings to be executed by controller in the second embodiment.

Next, description will be given below of the flow of processings to be executed by the air conditioning apparatus 1 of this embodiment with reference to a flow chart shown in FIG. 9. The flow chart of FIG. 9 shows the flow of processings relating to the first control, second control and third start control to be executed when the air conditioning apparatus 1 starts its operation, while ST designates "step" and a numeral following ST a step number. Here, in FIG. 9, description is given mainly of processings relating to this invention and thus the description of other ordinary processings such as the control of the refrigerant circuit corresponding to the operation conditions such as a set temperature and air amount instructed by a user is omitted. Also, since the first, second and third start control to be executed by CPU 110*a*, 110*b* are the same, in the following description, description will be given of processings relating to the first, second and third start control to be executed by CPU 110*a* provided in the controller 100*a* of the outdoor unit 2*a*.

On receiving an operation start instruction, CPU 110*a* checks whether the start condition of the first start control holds or not (ST21). When it holds (ST21—Yes), CPU 110*a* controls the first three-way valve 22*a* to allow the first outdoor heat exchanger 24*a* to function as an evaporator and controls the second three-way valve 23*a* to allow the second outdoor heat exchanger 25*a* to function as an evaporator (ST22).

Next, CPU 110*a* controls the compressor 21*a* to start at the start time rotation number, or, to drive it on at the start time rotation number (ST23).

Next, CPU 110*a* controls the valve opening rate of the first outdoor expansion valve 40*a* according to the refrigerant superheated degree in the refrigerant exit of the first outdoor heat exchanger 24*a* and opens the second outdoor expansion valve 41*a* fully (ST24).

Next, CPU 110*a* opens the first electromagnetic valve 42*a* (ST25) to thereby allow the refrigerant to flow in the hot gas bypass 36*a*. Here, as described in the first embodiment, the second electromagnetic valve 43*a* has been opened since the stopping time of the outdoor unit 2*a* and CPU 110*a* maintains this state to allow the refrigerant to flow in the oil return pipe 37*a*.

Next, CPU 110*a* checks whether the end condition of the first start control holds or not (ST26). When not (ST26—No), CPU 110*a* returns the processing to ST22 and continues the first start control.

When the end condition holds (ST26—Yes), CPU 110*a* ends the first start control and moves to the second start control. CPU 110*a* imports, of open-air temperatures detected by the open-air temperature sensor 58*a* and stored in the memory portion 120*a*, the open-air temperature T finally stored from the memory portion 120*a* (ST27).

Next, CPU 110*a* checks whether the imported open-air temperature T is −10° C. or lower or not (ST28). When it is −10° C. or lower (ST28—Yes), since it is not necessary to reduce the rotation number of the compressor 21*a* (see the rotation number table 200 of FIG. 8), CPU 110*a* advances the processing to ST31.

When not (ST28—No), CPU 110*a* refers to the rotation table 200 stored in the memory portion 120*a* and extracts the rotation number X corresponding to the imported open-air temperature T (ST29). And, CPU 110*a* reduces the rotation number of the compressor 21*a* down to the extracted rotation number X (ST30).

Next, CPU 110*a* checks whether the end condition of the second start control holds or not (ST31). When not (ST31—No), CPU 110*a* returns the processing to ST27.

When it holds (ST31—Yes), CPU 110*a* ends the second start control and moves to the third start control. CPU 110*a* checks whether an operation mode instructed by a user is a heating operation or a heating-based operation or not (ST32).

When it is a heating operation or a heating-based operation (ST32—Yes), CPU 110*a* switches the second outdoor heat exchanger 25*a* functioning as a condenser to function as an evaporator (ST33). Next, CPU 110*a* controls the valve opening rate of the first outdoor expansion valve 40*a* according to the refrigerant superheated degree in the refrigerant exit of the first outdoor heat exchanger 24*a* and controls the valve opening rate of the second outdoor expansion valve 41*a* according to the refrigerant superheated degree in the refrigerant exit of the second outdoor heat exchanger 25*a* (ST34). Next, CPU 110*a* returns the rotation number of the compressor 21*a* to the start time rotation number and drives the compressor 21*a* (ST35).

Next, CPU 110*a* starts a time after end of the second start control and checks whether a given time, for example, two minutes have passed or not since the end of the second start control (ST36). When not (ST36—No), CPU 110*a* returns the processing to ST32.

When a given time has passed (ST36—Yes), CPU 110*a* closes the first and second electromagnetic valves 42*a* and 43*a* (ST37) to thereby prevent the refrigerant from flowing in the hot gas bypass 36*a* and oil return pipe 37*a*.

Next, CPU 110*a* checks whether the end condition of the third start control holds or not (ST38). When not (ST38—No), CPU 110*a* drives on the compressor 21*a* at the start time rotation number (ST41) and returns the processing to ST38, thereby continuing the third start control. When the end condition holds (ST38—Yes), CPU 110*a* ends the third start control or ends the start control of the air conditioning apparatus 1 and starts its normal air conditioning control.

Here, in ST21, when the start condition of the first start control does not hold (ST21—No), CPU 110*a* does not execute the start control but starts the normal air conditioning control.

Also, in ST32, when not (ST32—No), the operation mode instructed by the user is a cooling operation or a cooling-based operation and, therefore, CPU 110*a* switches the first outdoor heat exchanger 24*a* functioning as an evaporator to function as a condenser (ST39). Next, CPU 110*a* opens the first outdoor expansion valve 40*a* fully or controls the valve opening rate thereof according to the refrigerant superheated degree in the refrigerant exit of the first outdoor heat exchanger 24*a*, and opens the second outdoor expansion valve 41*a* fully or controls the valve opening rate thereof according to the refrigerant superheated degree in the refrigerant exit of the second outdoor heat exchanger 25*a* (ST40). And, CPU 110*a* advances the processing to ST35.

In the above-described embodiment, description has been given of a case where, after the second start control is executed for a given time, the processing is moved to the third start control. However, the processing may also be moved to the third start control immediately when the rotation numbers of the compressors 21*a*, 21*b* are reduced down to the rotation number X corresponding to the open-air temperature T. For example, as described above, it takes 12 seconds to reduce the rotation numbers of the compressors 21*a*, 21*b* down to 46 rps. When the rotation numbers of the compressors 21*a*, 21*b* are reduced down to 46 rps, CPUs 110*a*, 110*b* may stop the second start control in 12 seconds and immediately move to the third start control. Also, when the open-air temperature T is −10° C. or lower and thus the rotation numbers of the compressors 21*a*, 21*b* need not be reduced (when the start time rotation number or 70 rps is maintained), CPUs 110*a*, 110*b* may not execute the second start control but, immediately after stopping the first start control, may execute the third start control.

Embodiment 3

Next, description will be given below of a third embodiment of the air conditioning apparatus of the invention. Here, since the structure and running operation of the air conditioning apparatus and the start condition of start control to be executed when the air conditioning apparatus starts are the same as those of the first embodiment, the description thereof is omitted. The third embodiment is different from the first embodiment in that, between the first and second start control in the first embodiment, there is executed control to reduce the rotation numbers of the compressors and also in that, in the second start control, the compressors are driven at the reduced rotation numbers provided by the above control to be executed between the first and second start control in the first embodiment and, during execution of the second start control, the first and second electromagnetic valves are retained opened.

Now, description will be given below of the operations of a refrigerant circuit of this embodiment and the operation effects thereof in the air conditioning apparatus 1 of this embodiment with reference to FIGS. 1 to 4, 10 and 11. Here, in the following description, similarly to the first embodiment, description will be given while taking an example where the air conditioning apparatus 1 starts its own operation and initiates the heating operation described with reference to FIG. 1 and the indoor units 8*a*-8*e* and outdoor units 2*a*, 2*b* are all operated.

In the first embodiment, in the case that the start control start condition (the start condition of the first start control) holds when the air conditioning apparatus 1 starts a heating operation, CPUs 110*a*, 110*b* execute the first start control and, following the end of the first start control, execute the second start control. When the control is switched from the first start control to the second start control, the second outdoor heat exchangers 25*a*, 25*b* functioning as condensers in the first start control are switched to function as evaporators. This removes the outdoor heat exchanger functioning as a condenser, thereby increasing the high pressure (the pressure on the discharge sides of the compressors 21*a*, 21*b*).

At the then time, when the open-air temperature is relatively high (for example, −9° C. or higher), since the second outdoor heat exchangers 25*a*, 25*b* functioning as condensers are switched to function as evaporators, the condensation capacity is reduced. This increases the high pressure and thus the operation loads of the compressors 21*a*, 21*b*, raising a fear that the discharge outputs of the compressors 21*a*, 21*b* can exceed the upper limit values thereof. This raises a fear that overload protection control to stop the compressors 21*a*, 21*b* to thereby prevent the increased discharge outputs can be executed.

Figure 10:
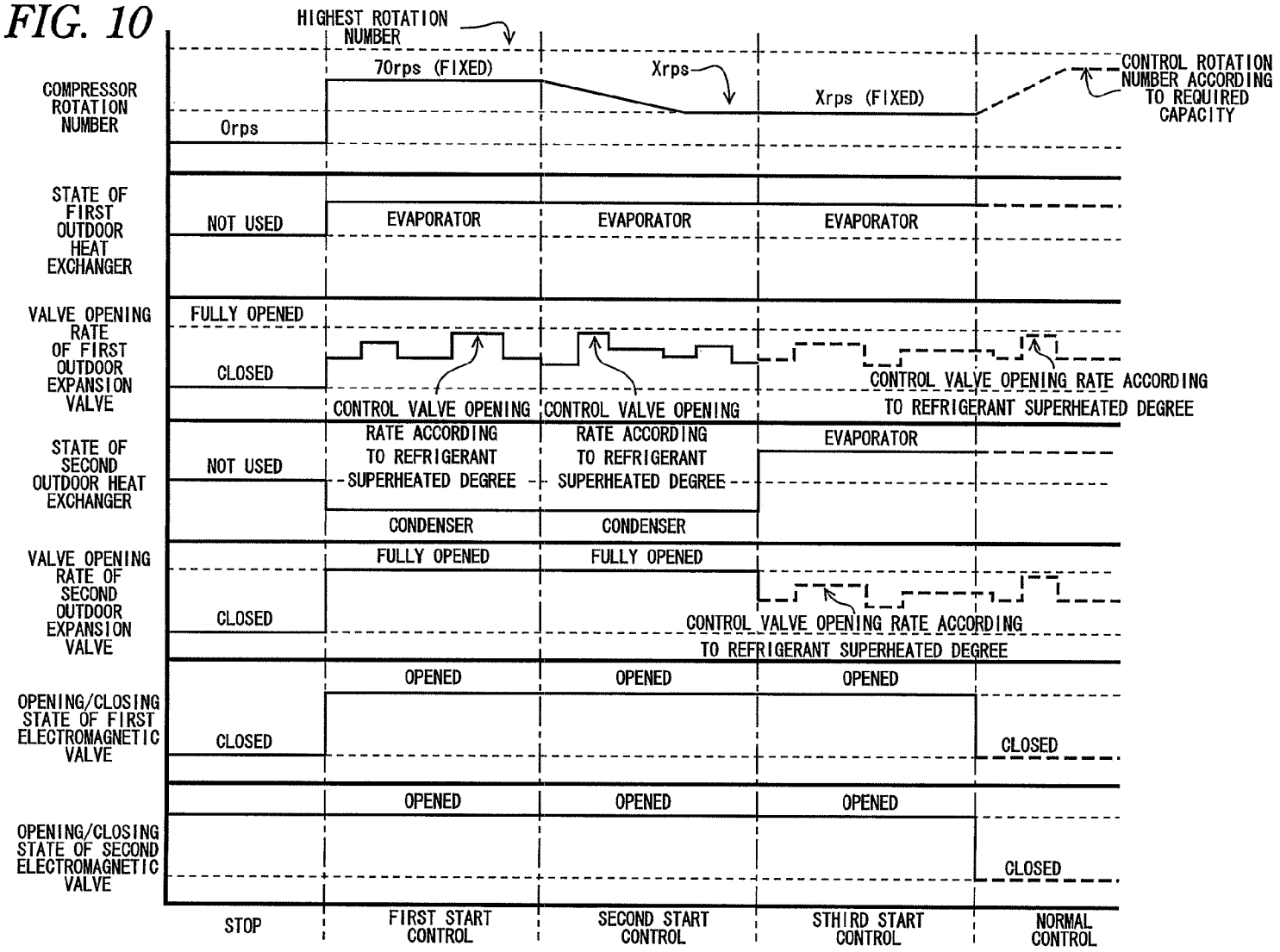
FIG. 10 is a timing chart in the third embodiment of the invention, showing the operations of the respective composing elements when executing the first, second, and third start control.

In this embodiment, to solve the above problems, as shown in FIG. 10, when starting the air conditioner 1, there is executed start control including: first start control (the same control as the first start control in the first embodiment) to be executed mainly for eliminating the refrigerant dissolution within the compressors 21*a* and 21*b* to thereby reduce the amount of refrigerating oil to be discharged together with the refrigerant; second start control to be executed mainly for preventing the discharge pressures of the compressors 21*a* and 21*b* from exceeding the upper limit values thereof; and, third start control (the same control in the second start control in the first embodiment, except for the control of the rotation numbers of the compressors 21*a* and 21*b*, and the opening/closing control of the first electromagnetic valves 42*a*, 42*b* and second electromagnetic valves 43*a*, 43*b*) to be executed mainly to prevent the discharge pressures of the compressors 21*a* and 21*b* from increasing suddenly and also to switch the function of the second outdoor heat exchangers 25*a* and 25*b* from the function of a condenser to that of an evaporator.

The above-mentioned start control will be described below specifically. However, since the first start control is the same as the first start control in the first embodiment including the start condition and end condition, the description thereof is omitted here. Also, the third start control is the same as the second start control in the first embodiment except for the control of the rotation numbers of the compressors 21*a* and 21*b*, and the opening/closing control of the first electromagnetic valves 42*a*, 42*b* and second electromagnetic valves 43*a*, 43*b* to be described later. Therefore, the description of the same part of this control is omitted here. And, the following description is given assuming that the lower limit rotation number in the rotation number range allowed for the compressors 21*a* and 21*b* is 20 rps.

[Second Start Control]

When the end condition of the first start control holds, CPUs 110*a*, 110*b* start the second start control following the first start control. In the second start control, the rotation numbers of the compressors 21*a*, 21*b* are reduced at a given rate from 70 rps, namely, the rotation number (start time rotation number) during the first start control execution down to a rotation number X (rps) previously set according to the open-air temperatures, thereby reducing the discharge pressures of the compressors 21*a*, 21*b*.

In memory portions 120*a*, 120*b* respectively corresponding to CPU 110*a*, 110*b*, there is previously stored a rotation number table 200 shown in FIG. 8. The table 200 sets the rotation numbers X (rps) of the compressors 21*a*, 21*b* according to the then-time open-air temperatures T (° C.) when executing the second start control. In this table, by previously conducting tests and the like, it has been confirmed that, when the rotation numbers of the compressors 21*a*, 21*b* are reduced down to the rotation numbers X, the discharge pressures of the compressors 21*a*, 21*b* are prevented from exceeding their upper limit values at the corresponding open-air temperatures T.

In the rotation number table 200, the open-air temperatures T are divided by 1° C. between "−10° C. or lower" and "11° C. or higher". The rotation numbers X are determined correspondingly to the open-air temperatures T. Specifically, when the open-air temperatures T are "−10° C. or lower", since a fear of the discharge pressures of the compressors 21*a*, 21*b* exceeding their upper limit values is low, the rotation number X is set at "70 rps", namely, the start time rotation number.

When the open-air temperatures T are higher than −10° C., there is a fear that the discharge pressures of the compressors 21*a*, 21*b* can exceed the upper limit values and, the higher the open-air temperatures T become, the higher the possibility of the discharge outputs exceeding the upper limit values becomes. Therefore, in the rotation number table 200, the higher the open-air temperatures T become, the lower the rotation numbers X become. For example, when the open-air temperature T is −5°, the rotation number X is 58 rps; for the open-air temperature T of 0° C., 46 rps; and, for the open-air temperature T of 5° C., 35 rps. For the open-air temperature T of 11° C. or higher, the rotation number X is 20 rps or the lower limit rotation number.

Next, description will be given below of the specific operations of the respective composing elements of the outdoor units 2*a*, 2*b* when executing the second start control. CPUs 110*a*, 110*b*, in the second start control, as shown in FIG. 10, execute the rotation number control of the compressors 21*a*, 21*b*, the function switching (evaporator/condenser switching) control of the first outdoor heat exchangers 24*a*, 24*b* and second outdoor heat exchangers 25*a*, 25*b*, the valve opening rate control of the first outdoor expansion valves 40*a*, 40*b* and second outdoor expansion valves 41*a*, 41*b*, and the opening/closing control of the first electromagnetic valves 42*a*, 42*b* and second electromagnetic valves 43*a*, 43*b*.

The above respective kinds of control included in the second start control are similar to those of the first start control except for the rotation number control of the compressors 21*a*, 21*b*. Therefore, the description thereof is omitted here and thus the rotation number control of the compressors 21*a*, 21*b* will be described below specifically. Here, the state of the refrigerant circuit of the air conditioning apparatus 1 when executing the second start control is similar to that of the first start control in the first embodiment, that is, the state shown in FIG. 3.

The memory portions 120*a*, 120*b* store therein in a time series manner the open-air temperatures detected at a given timing (for example, every two seconds) by the open-air temperature sensors 58*a*, 58*b* serving as the open-air temperature detecting devices provided in the respective outdoor units 2*a*, 2*b*. On starting the second start control, CPUs 110*a*, 110*b* import the finally stored open-air temperature T from the open-air temperatures stored in the memory portions 120*a*, 120*b*. CPUs 110*a*, 110*b* refer to the rotation number table 200 similarly stored in the memory portions 120*a*, 120*b* and extract from the rotation number table 200 the rotation number X corresponding to the imported open-air temperature T.

Next, CPUs 110*a*, 110*b* reduce the rotation number of the compressors 21*a*, 21*b* from the current rotation number, namely, 70 rps or the start time rotation number down to the extracted rotation number X at a predetermined given rate. For example, when the open-air temperature T is 0° C. and the given rate for reducing the rotation number is 2 rps/sec, since the rotation number table 200 shows that the rotation number X when the open-air temperature T is 0° C. is 46 rps, CPUs 110*a*, 110*b* reduce the rotation number of the compressors 21*a*, 21*b* down to 46 rps in twelve seconds ((70 rps−46 rps)/2 rps/sec=12 seconds). By reducing the rotation numbers of the compressors 21*a*, 21*b* in this manner, the discharge outputs of the compressors 21*a*, 21*b* are reduced.

CPUs 110*a*, 110*b*, during execution of the second start control, is checking whether the end condition of the second start control holds or not, and when the end condition holds, end the second start control and move to third start control to be described next. Here, the end condition of the second start control is, for example, whether a given time has passed since the start of the second start control or not. This given time is a previously determined in consideration of time necessary to reduce the rotation numbers of the compressors 21*a*, 21*b* down to the lower limit rotation number, 20 rps. For example, when a given rate for reducing the rotation number is above-mentioned 2 rps/1 sec, there is obtained (70 rps−20 rps)/2 rps=25 seconds.

Therefore, when time necessary to reduce the rotation numbers of the compressors 21*a*, 21*b* down to the rotation number X corresponding to the open-air temperature T is shorter than the given time (for example, 25 seconds), CPUs 110*a*, 110*b*, after reducing the rotation numbers of the compressors 21*a*, 21*b* down to the rotation number X, drive the compressors 21*a*, 21*b* while maintaining the rotation number X until the given time. For example, as described above, since the rotation number X is 46 rps when the open-air temperature T is 0° C. and thus 12 seconds are necessary to reduce the rotation number down to this rotation number, CPUs 110*a*, 110*b* drive the compressors 21*a*, 21*b* at 46 rps for the remaining thirteen seconds. Here, since, when the open-air temperature is −10° C. or lower, the rotation number X is 70 rps or the start time rotation number, CPUs 110*a*, 110*b* drive the compressors 21*a*, 21*b* for a given time (25 seconds) while maintaining 70 rps.

[Third Start Control]

CPUs 110*a*, 110*b* start the third start control following the second start control. Due to execution of the first start control, the refrigerant dissolution within the compressors 21*a* and 21*b* has been eliminated to a certain degree, whereby the discharge amount of the refrigerating oil has become such amount as the refrigerating oil cannot interfere with the lubrication of the compressors 21*a* and 21*b*. Also, owing to execution of the second start control, the discharge pressures of the compressors 21*a* and 21*b* have been lowered. In the third start control, there is carried out various control in order to reduce the refrigerant dissolution within the compressors 21*a* and 21*b* and also to prevent the lowered durability of the compressors 21*a* and 21*b* caused when the discharge pressures of the compressors 21*a* and 21*b* are allowed to increase suddenly to thereby wear and deteriorate the sliding portions of the compressors 21*a* and 21*b*.

Here, in the first and second start control, the two outdoor heat exchangers are structured to differ in function from each other and the evaporator and condenser coexist within the outdoor unit. In the third start control, for the heating operation/heating-based operation, the two outdoor heat exchangers are both controlled to function as evaporators, or, for the cooling operation/cooling-based operation, the two outdoor heat exchangers are both controlled to function as condensers, thereby preparing transition to the normal operation.

Next, description will be given of the specific operations of the respective composing elements of the outdoor units 2*a*, 2*a* when executing the third start control. In this embodiment, in order for the air conditioning apparatus 1 to carry out a heating operation, CPU 110*a*, 110*b*, in the third start control, as shown in FIG. 10, execute the rotation number control of the compressors 21*a*, 21*b*, the function switching (switching from condenser to evaporator. Since the first outdoor heat exchangers 24*a*, 24*b* are controlled to function as evaporators in the first and second start control, they are maintained in state) control of the second outdoor heat exchangers 25*a*, 25*b*, the valve opening rate control of the first outdoor expansion valves 40*a*, 40*b* and second outdoor expansion valves 41*a*, 41*b*, and the opening/closing control of the first electromagnetic valves 42*a*, 42*b* and second electromagnetic valves 43*a*, 43*b*.

Of the above-mentioned control, other control than the control of the rotation number of the compressors 21*a* and 21*b* and the opening/closing control of the first electromagnetic valves 42*a*, 42*b* and second electromagnetic valves 43*a*, 43*b* is the same as the second start control in the first embodiment including the end condition. Therefore, the description thereof is omitted here and description will be given below specifically of the control of the rotation number of the compressors 21*a* and 21*b* and the opening/closing control of the first electromagnetic valves 42*a*, 42*b* and second electromagnetic valves 43*a*, 43*b*. Here, the state of the refrigerant circuit of the air conditioning apparatus 1 when executing the third start control is similar to the state for the second start control in the first embodiment, or, the state shown in FIG. 4.

CPUs 110*a*, 110*b*, after starting the third start control, as shown in FIG. 10, fix the rotation number of the compressors 21*a* and 21*b* to the rotation number X set in the second start control and drive the compressors 21*a* and 21*b* at this rotation number X until the third start control ends. Also, CPUs 110*a*, 110*b* retain the opened states of the first electromagnetic valves 42*a*, 42*b* and second electromagnetic valves 43*a*, 43*b* until the third start control ends.

In the second start control, since the rotation number of the compressors 21*a* and 21*b* is set to the rotation number X corresponding to the open-air temperature, the discharge pressures of the compressors 21*a* and 21*b* are prevented from exceeding their respective upper limit values when the second start control is switched to the third start control. However, in the third start control, the second outdoor heat exchangers 25*a*, 25*b* having functioned as condensers are switched to function as evaporators, thereby reducing the number of heat exchangers functioning as condensers. This raises a fear that the discharge pressures of the compressors 21*a* and 21*b* can increase suddenly. With such sudden increase in the discharge pressures of the compressors 21*a* and 21*b*, a large load is applied to the sliding portions of the compressors 21*a* and 21*b*. This raises a fear that the sliding portions can be worn and deteriorated to thereby lower the durability of the compressors 21*a* and 21*b*.

To solve the above problem, in the third start control, the rotation number of the compressors 21*a* and 21*b* is set to the rotation number X and the first electromagnetic valves 42*a*, 42*b* and second electromagnetic valves 43*a*, 43*b* are retained opened continuously from the first and second start control. This can prevent the discharge pressures of the compressors 21*a* and 21*b* from increasing suddenly, thereby being able to prevent the lowered durability of the compressors 21*a* and 21*b*.

Here, the end condition of the third start control is whether a given time (for example, 10 seconds) has passed since the start of the third start control or not. This given time is decided by taking into consideration the time necessary to switch the function of the second outdoor heat exchangers 25*a*, 25*b* from that of a condenser to that of an evaporator and the time necessary to slacken the increasing degree of the discharge pressures of the compressors 21*a* and 21*b* by executing the third start control when the discharge pressures of the compressors 21*a* and 21*b* are going to increase suddenly due to the reduced number of heat exchangers functioning as condensers. When the end condition of the third start control holds, CPUs 110*a*, 110*b* end the start control of the air conditioner 1 and moves to the normal air conditioning control.

Figure 11:
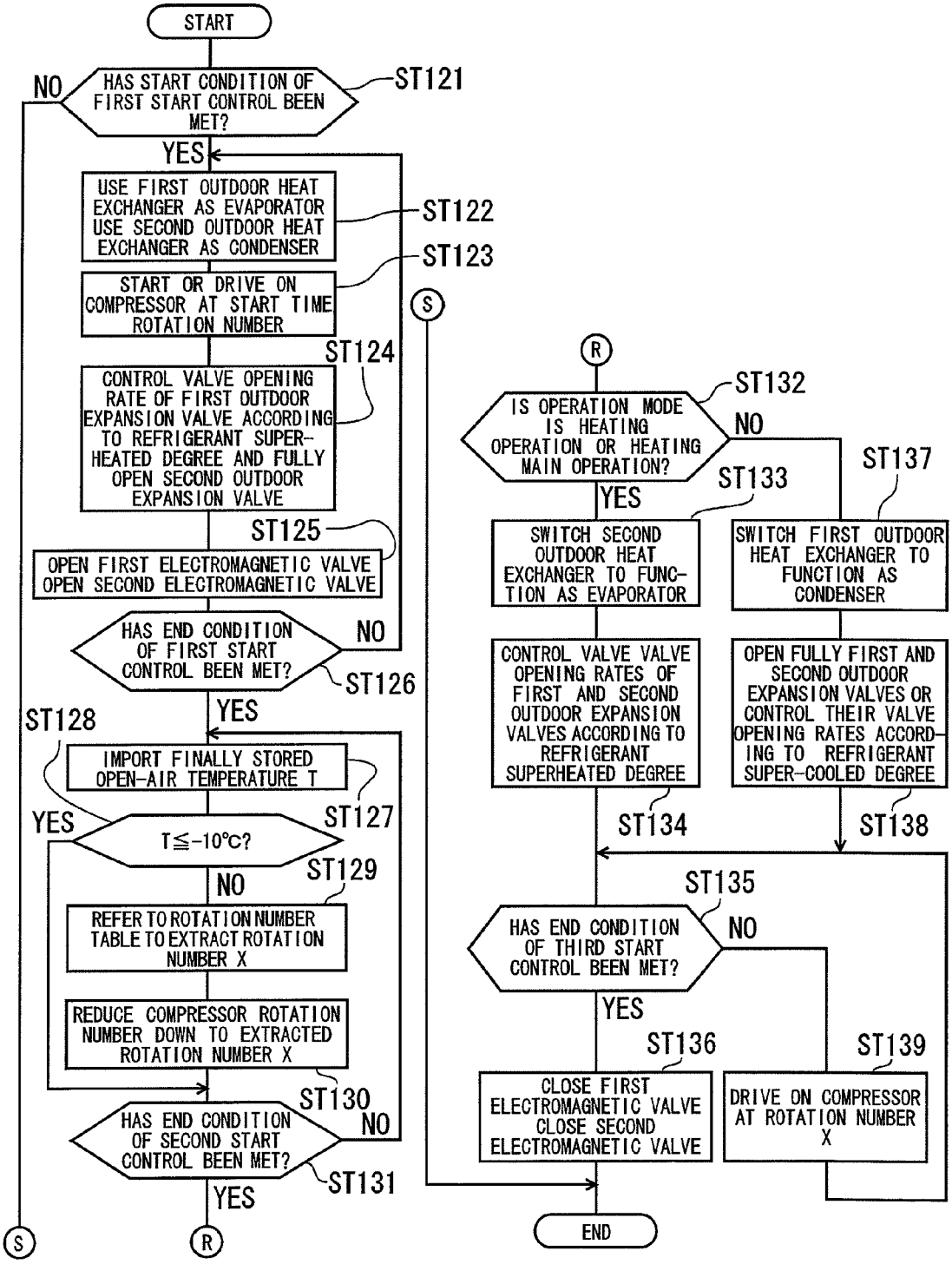
FIG. 11 is a flow chart of processings to be executed by controller in the third embodiment.

Next, description will be given below of the flow of processings to be executed by the air conditioning apparatus 1 of this embodiment with reference to a flow chart shown in FIG. 11. The flow chart of FIG. 11 shows the flow of processings relating to the first control, second control and third start control to be executed when the air conditioning apparatus 1 starts its operation, while ST designates "step" and a numeral following ST a step number. Here, in FIG. 11, description is given mainly of processings relating to this invention and thus the description of other ordinary processings such as the control of the refrigerant circuit corresponding to the operation conditions such as a set temperature and air amount instructed by a user is omitted. Also, since the first, second and third start control to be executed by CPU 110*a*, 110*b* are the same, in the following description, description will be given of processings relating to the first, second and third start control to be executed by CPU 110*a* provided in the controller 100*a* of the outdoor unit 2*a*.

On receiving an operation start instruction, CPU 110*a* checks whether the start condition of the first start control holds or not (ST 121). When it holds (ST 121—Yes), CPU 110*a* controls the first three-way valve 22*a* to allow the first outdoor heat exchanger 24*a* to function as an evaporator and controls the second three-way valve 23*a* to allow the second outdoor heat exchanger 25*a* to function as an evaporator (ST 122).

Next, CPU 110*a* controls the compressor 21*a* to start at the start time rotation number, or, to drive it on at the start time rotation number (ST 123).

Next, CPU 110*a* controls the valve opening rate of the first outdoor expansion valve 40*a* according to the refrigerant superheated degree in the refrigerant exit of the first outdoor heat exchanger 24*a* and opens the second outdoor expansion valve 41*a* fully (ST 124).

Next, CPU 110*a* opens the first electromagnetic valve 42*a* (ST 125) to thereby allow the refrigerant to flow in the hot gas bypass 36*a*. Here, as described in the first embodiment, the second electromagnetic valve 43*a* has been opened since the stopping time of the outdoor unit 2*a* and CPU 110*a* maintains this state to allow the refrigerant to flow in the oil return pipe 37*a*.

Next, CPU 110*a* checks whether the end condition of the first start control holds or not (ST 126). When not (ST 126—No), CPU 110*a* returns the processing to ST 122 and continues the first start control.

When the end condition holds (ST 126—Yes), CPU 110*a* ends the first start control and moves to the second start control. CPU 110*a* imports, of open-air temperatures detected by the open-air temperature sensor 58*a* and stored in the memory portion 120*a*, the open-air temperature T finally stored from the memory portion 120*a* (ST 127).

Next, CPU 110*a* checks whether the imported open-air temperature T is −10° C. or lower or not (ST 128). When it is −10° C. or lower (ST 128—Yes), since it is not necessary to reduce the rotation number of the compressor 21*a* (see the rotation number table 200 of FIG. 8), CPU 110*a* advances the processing to ST 131.

When not (ST 128—No), CPU 110*a* refers to the rotation table 200 stored in the memory portion 120*a* and extracts the rotation number X corresponding to the imported open-air temperature T (ST 129). And, CPU 110*a* reduces the rotation number of the compressor 21*a* down to the extracted rotation number X (ST 130).

Next, CPU 110*a* checks whether the end condition of the second start control holds or not (ST 131). When not (ST 131—No), CPU 110*a* returns the processing to (ST 127).

When it holds (ST 131—Yes), CPU 110*a* ends the second start control and moves to the third start control. CPU 110*a* checks whether an operation mode instructed by a user is a heating operation or a heating-based operation or not (ST 132).

When it is a heating operation or a heating-based operation (ST 132—Yes), CPU 110*a* switches the second outdoor heat exchanger 25*a* functioning as a condenser to function as an evaporator (ST 133). Next, CPU 110*a* controls the valve opening rate of the first outdoor expansion valve 40*a* according to the refrigerant superheated degree in the refrigerant exit of the first outdoor heat exchanger 24*a* and controls the valve opening rate of the second outdoor expansion valve 41*a* according to the refrigerant superheated degree in the refrigerant exit of the second outdoor heat exchanger 25*a* (ST 134).

Next, CPU 110*a* checks whether the end condition of the third start control holds or not (ST 135). When not (ST 135—No), CPU 110*a* drives the compressor 21*a* with the rotation number X maintained (ST 139) and returns the processing to ST 135.

When the end condition of the third start control holds (ST 135—Yes), CPU 110*a* closes the first electromagnetic valve 42*a* and second electromagnetic valve 43*a* (ST 136) to prevent a refrigerant from flowing in the hot gas bypass pipe 36*a* and oil return pipe 37*a*, thereby ending the third start control, that is, ending the start control of the air conditioner 1 and starting the normal air conditioning control.

Next, CPU 110*a* checks whether the end condition of the third start control holds or not (ST 138). When not (ST 138—No), CPU 110*a* drives on the compressor 21*a* at the start time rotation number (ST 141) and returns the processing to ST 138, thereby continuing the third start control. When the end condition holds (ST 138—Yes), CPU 110*a* ends the third start control or ends the start control of the air conditioning apparatus 1 and starts its normal air conditioning control.

Here, in ST 121, when the start condition of the first start control does not hold (ST 121—No), CPU 110*a* does not execute the start control but starts the normal air conditioning control.

Also, in ST 132, when not (ST 132—No), the operation mode instructed by the user is a cooling operation or a cooling-based operation and, therefore, CPU 110*a* switches the first outdoor heat exchanger 24*a* functioning as an evaporator to function as a condenser (ST 139). Next, CPU 110*a* opens the first outdoor expansion valve 40*a* fully or controls the valve opening rate thereof according to the refrigerant superheated degree in the refrigerant exit of the first outdoor heat exchanger 24*a*, and opens the second outdoor expansion valve 41*a* fully or controls the valve opening rate thereof according to the refrigerant superheated degree in the refrigerant exit of the second outdoor heat exchanger 25*a* (ST 140). And, CPU 110*a* advances the processing to (ST 135).

In the above-described embodiment, description has been given of a case where, after the second start control is executed for a given time, the processing is moved to the third start control. However, the processing may also be moved to the third start control immediately when the rotation numbers of the compressors 21*a*, 21*b* are reduced down to the rotation number X corresponding to the open-air temperature T. For example, as described above, it takes 12 seconds to reduce the rotation numbers of the compressors 21*a*, 21*b* down to 46 rps. When the rotation numbers of the compressors 21*a*, 21*b* are reduced down to 46 rps, CPUs 110*a*, 110*b* may stop the second start control in 12 seconds and immediately move to the third start control. Also, when the open-air temperature T is −10° C. or lower and thus the rotation numbers of the compressors 21*a*, 21*b* need not be reduced (when the start time rotation number or 70 rps is maintained), CPUs 110*a*, 110*b* may not execute the second start control but, immediately after stopping the first start control, may execute the third start control.

As described above, according the air conditioning apparatus of the invention, even when the compressors are driven on at a given rotation number in order to eliminate the refrigerant dissolution of the compressors early, by controlling part of the outdoor heat exchangers to function as a condenser, an increase in the discharge side (high pressure side) pressure of the compressor can be prevented. This can prevent the increased internal pressure of the compressor and thus can prevent the occurrence of refrigerant dissolution caused by the increased internal pressure of the compressor. Also, after end of the first start control, while the outdoor heat exchangers are all controlled to function as condensers or evaporators according to the operation mode of the normal air conditioning operation, the compressors are driven on at the same given rotation numbers as those in the first start control execution. This enables the air conditioning capacity to rise quickly.

What is claimed is:

1. An air conditioning apparatus comprising:

at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the one or more compressors, outdoor expansion valves each connected to the other end of each of the outdoor heat exchangers for adjusting the refrigerant flow amount of the outdoor heat exchangers, and controller for executing the switching control of the flow passage switching devices and the valve opening rate control of the outdoor expansion valves; and, an indoor unit to be connected to the outdoor unit by at least two refrigerant pipes, wherein when a first given condition holds in the start operation of the outdoor unit, the controller executes first start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number.

2. The air conditioning apparatus according to claim 1, wherein the controller, when a second given condition holds during execution of the first start control, the controller executes second start control following the first start control, in the second start control, the controller controls the flow passage switching devices corresponding to the outdoor heat exchangers to allow all of the outdoor heat exchangers used to function as condensers or evaporators, and continuously drives the one or more compressors at the same rotation number as in the first start control.

3. An air conditioning apparatus comprising:

at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the one or more compressors, outdoor expansion valves each connected to the other end of each of the outdoor heat exchangers for adjusting the refrigerant flow amount of the outdoor heat exchangers, open-air temperature detecting device for detecting open-air temperatures, and controller for executing the switching control of the flow passage switching devices and the valve opening rate control of the outdoor expansion valves; and, an indoor unit to be connected to the outdoor unit by at least two refrigerant pipes, wherein when a first given condition holds in the start operation of the outdoor unit, the controller executes start control including first start control, second start control and third start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number, in the second start control executed following the first start control, the controller drives the one or more compressors at a rotation number predetermined according to the open-air temperature detected by the open-air temperature detecting device reduced from the predetermined rotation number in the first start control, and in the third start control executed following the second start control, the controller controls the flow passage switching devices corresponding to the outdoor heat exchangers to allow all of the outdoor heat exchangers used to function as condensers or evaporators, and drives the one or more compressors at the rotation number returned to the same rotation number set in the first start control.

4. An air conditioning apparatus comprising:

at least one outdoor unit including at least one compressor, at least two outdoor heat exchangers, flow passage switching devices connected to one end of each of the outdoor heat exchangers for switching the connection of the outdoor heat exchangers to the refrigerant discharge opening or refrigerant suction opening of the compressor, outdoor expansion valves each connected to the other end of each of the outdoor heat exchangers for adjusting the refrigerant flow amount of the outdoor heat exchangers, open-air temperature detecting device for detecting open-air temperatures, and controller for executing the switching control of the flow passage switching devices and the valve opening rate control of the outdoor expansion valves; and, an indoor unit to be connected to the outdoor unit by at least two refrigerant pipes, wherein the controller, when a first given condition holds in the start operation of the outdoor unit, executes start control including first start control, second start control and third start control, in the first start control, the controller controls the flow passage switching devices corresponding to the one or more outdoor heat exchangers to allow it or them to function as an evaporator or evaporators, controls the flow passage switching devices corresponding to at least one of the other outdoor heat exchangers than one functioning as an evaporator to allow it or them to function as a condenser or condensers, and drives the one or more compressors at a predetermined rotation number, in the second start control executed following the first start control, the controller drives the one or more compressors at a predetermined rotation number of the one or more compressors reduced from a given number of rotation in the first start control down to a predetermined rotation number according to the open-air temperature detected the one or more compressors at a rotation number predetermined according to the open-air temperature detected by the open-air temperature detecting device reduced from the predetermined rotation number in the first start control, and in the third start control executed following the second start control, the controller controls the flow passage switching devices corresponding to the outdoor heat exchangers to allow all of the outdoor heat exchangers used to function as condensers or evaporators, and to drive the one or more compressors at a rotation number maintained at the rotation number set in the second start control.

* * * * *